US006146273A

United States Patent [19]

Olsen

[11] Patent Number: 6,146,273

[45] **Date of Patent: *Nov. 14, 2000**

[54] PROGRESSIVE JACKPOT GAMING SYSTEM WITH SECRET BONUS POOL

[75] Inventor: Eric Burton Olsen, Henderson, Nev.

[73] Assignee: Mikohn Gaming Corporation, Las Vegas, Nev.

[ * ] Notice: This patent issued on a continued prosecution application filed under 37 CFR 1.53(d), and is subject to the twenty year patent term provisions of 35 U.S.C. 154(a)(2).

[21] Appl. No.: 09/052,047

[22] Filed: Mar. 30, 1998

Related U.S. Application Data

[63] Continuation-in-part of application No. 08/957,076, Oct. 24, 1997.

[51] Int. Cl.[7] ..... A63F 9/24

[52] U.S. Cl. ..... 463/27

[58] Field of Search ..... 463/16, 17, 19, 463/22, 25, 26, 27, 28, 31

[56] References Cited

U.S. PATENT DOCUMENTS

| | | | |
|---|---|---|---|
| 5,885,158 | 3/1999 | Torango et al. . | |
| 5,947,820 | 9/1999 | Morro et al. | 463/9 |
| 5,980,384 | 11/1999 | Barrie | 463/16 |
| 5,989,121 | 11/1999 | Sakamoto | 463/20 |
| 6,012,982 | 3/2000 | Piechowiak et al. | 463/16 |
| 6,033,307 | 3/2000 | Vancura | 463/20 |

FOREIGN PATENT DOCUMENTS

| | | |
|---|---|---|
| B-36472/95 | 5/1996 | Australia . |
| 2 151 054 | 7/1985 | United Kingdom . |

OTHER PUBLICATIONS

John Acres, Gaming Innovations Concept III, circa Mar. 1993, 18 pages.

Form SB–2 Registration Statement Under the Securities Act of 1933, Sep. 20, 1993, 51 pages—Acres Gaming.

PCT International Search Report, Mar. 15, 1999, 3 pages.

*Primary Examiner*—Valencia Martin-Wallace
*Assistant Examiner*—John Paradiso
*Attorney, Agent, or Firm*—Dorr, Carson, Sloan & Birney, P.C.

[57] ABSTRACT

A method of operating of controller-based progressive gaming system having a plurality of gaming machines wherein each gaming machine generates unit bet information indicative of a number of unit bets supplied to a machine for playing a game. The method comprises the steps of randomly selecting a bonus mode activation value between a high and low limit, providing a current value, providing a base value, incrementing the current value when the gaming machines are played so that the current value is incremented by a fixed amount of each unit bet received by each gaming machine. A bonus mode time period is entered when the incremented current value is equal to or exceeds the bonus value. Eligible machines are locked-in and random bonus jackpots are made during the bonus time period. Each bonus award decrements the current value by the amount of each award and the bonus mode time period is ended when the current value is less than or equal to the base value.

29 Claims, 16 Drawing Sheets

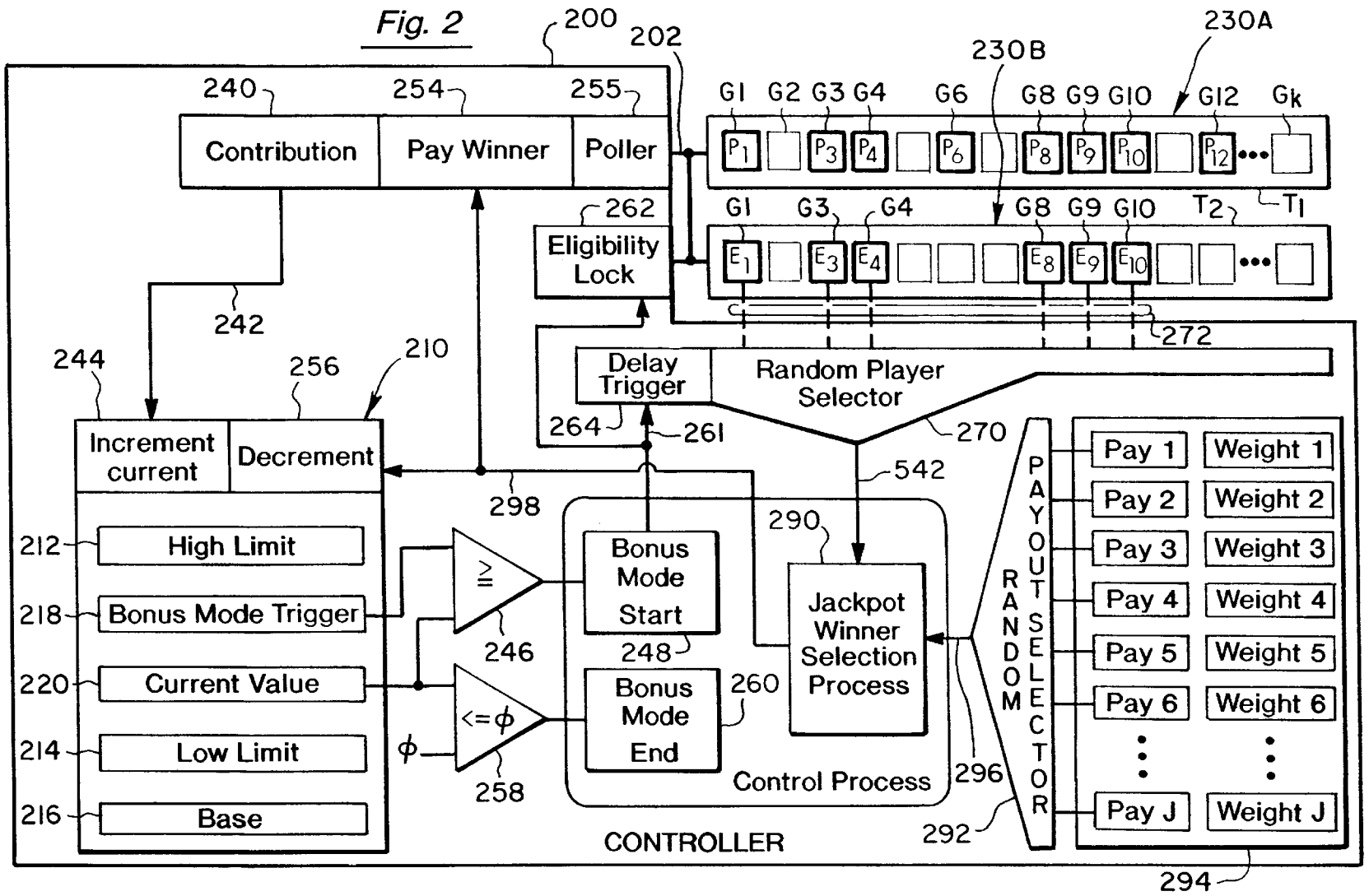
Fig. 2
200
202
230A
230B
G1 G2 G3 G4 G6 G8 G9 G10 G12 Gk
T1 T2
P1 P3 P4 P6 P8 P9 P10 P12
E1 E3 E4 E8 E9 E10
272
Random Player Selector
270
542
Delay Trigger
261
264
Eligibility Lock
262
Poller
255
Pay Winner
254
Contribution
240
242
Pay 1 Pay 2 Pay 3 Pay 4 Pay 5 Pay 6 Pay J
Weight 1 Weight 2 Weight 3 Weight 4 Weight 5 Weight 6 Weight J
294
PAYOUT TRANSDUCTOR
292
296
Jackpot Winner Selection Process
290
Control Process
CONTROLLER
Bonus Mode Start
248
Bonus Mode End
260
298
246
258
210
256
Decrement
Increment current
244
High Limit
Bonus Mode Trigger
Current Value
Low Limit
Base
212
218
220
214
216

Fig. 7
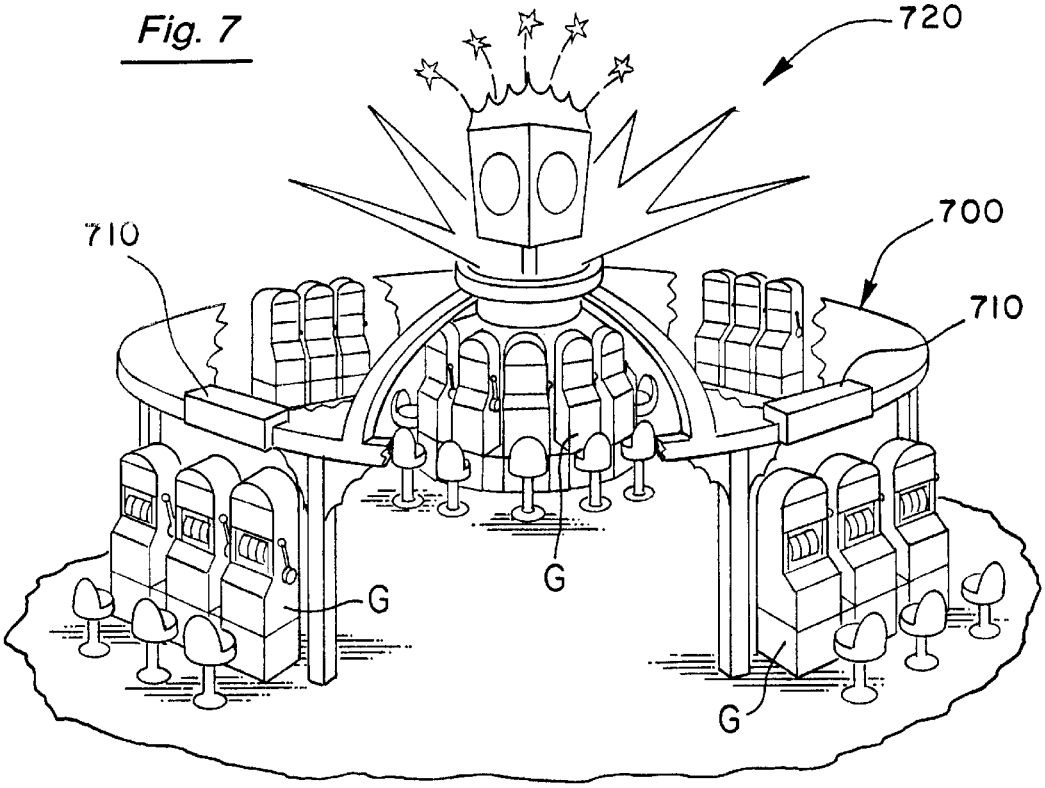
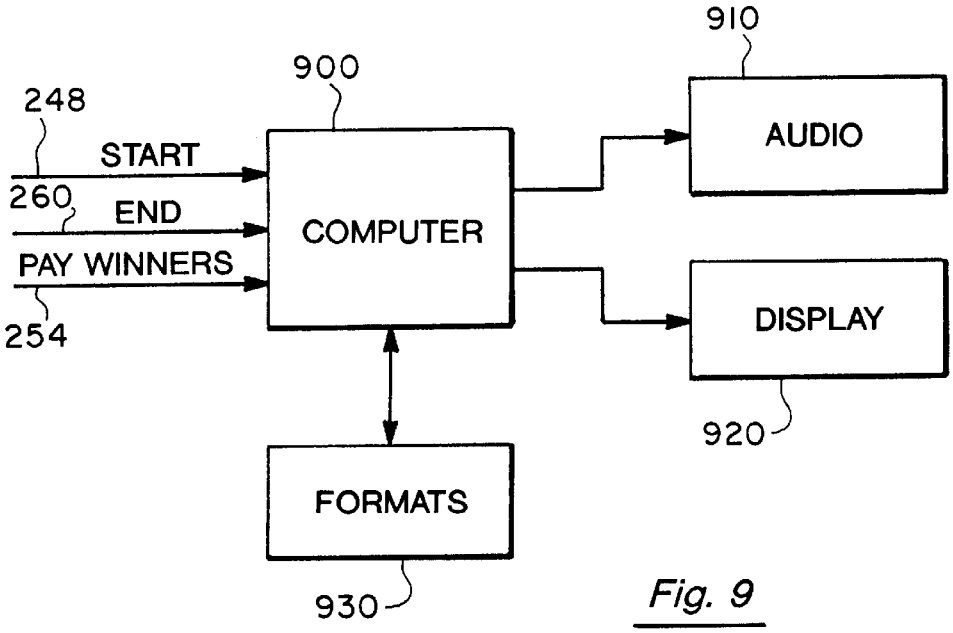
Fig. 9

Reset
1000
Attract Mode ?
1010
Yes
No
Activate Attract Mode
1020
Eligible ?
1030
Yes
No
Update Eligibility
1040
Bonus Mode Start ?
1070
Yes
No
Start Bonus
1080
Bonus Mode End ?
1090
No
End Bonus
1092
Jackpot Hit ?
1094
Yes
No
Jackpot Celebration
1096

PROGRESSIVE JACKPOT GAMING SYSTEM WITH SECRET BONUS POOL

RELATED INVENTIONS

This invention is a Continuation-in-Part of Ser. No. 08/957,076 filed Oct. 24, 1997 and entitled "Controller-Based Progressive Jackpot Gaming System."

BACKGROUND OF THE INVENTION

1. Field of the Invention

This invention relates to gaming machines and, in particular, to controller-based progressive jackpot linked gaming systems.

2. Statement of the Problem

Gaming machines are well known and include a variety of games such as slot, poker, and keno. Gaming machines can also be programmed to play a variety of games. Players insert monetary amounts by inserting coin, token, paper currency, or magnetic card; pushing credit buttons; or other suitable entry to play one or more games on a particular gaming machine. Such monetary amounts are usually translated into a number of units of the lowest unit of currency receivable by the machine, referred to herein as the unit bet. Translation into unit bet is conventionally carried out by representing each unit bet as a single pulse so that the generation of P pulses would correspond to a currency entry equal to P unit bets. Thus, in a gaming machine whose unit bet equals one dollar, the entry of three "dollar unit bets" corresponds to P equals three, resulting in the generation of three pulses within the machine. The monetary value may also be digitized and sent as a digital signal. Such operation is well known in the art.

Upon entry of a monetary amount, the gaming machine examines the generated unit bet pulses and determines therefrom which games and/or awards the player qualifies for based upon an internal game in the machine and on an associated pay table located in the machine. The player is then normally required to take some action to institute playing of the game such as pushing a play button or pulling a lever arm. The player then plays the game according to the rules of the game. The player either wins the game or loses the game. If the player wins the game, the player is given the award established by the gaming machine for the particular game being played. This award varies considerably from type of game played to the type of winning combination in the rules of the game. Typically, the award is a return of monetary amounts equal to or in excess of the monetary amounts entered to play the game. Winning or losing the game completes the gaming cycle. The gaming machine then conditions itself so as to be able to again receive monetary amounts to begin another game cycle and the process repeats. Such individual stand-alone conventional gaming machines are found in numerous casinos throughout the world and are made by a number of different manufacturers.

In order to attract more players to such gaming machines, progressive gaming systems were developed. Progressive gaming systems permit the player to play individual gaming machines as discussed above. To add to the excitement of play, the individual gaming machines are linked together to allow players to compete for an additional common award or "progressive jackpot." The progressive jackpot award can amount to a substantial amount of money. Progressive gaming systems are also found in casinos throughout the world. In some environments, the progressive jackpot award is an expensive vehicle, such as a motorcycle or sports car. In progressive gaming systems, a programmed controller is provided for linking the machines together. The controller receives the unit bets from the linked machines as well as machine identification information from each machine and supplies to the players, either through displays provided on their respective machines and/or a common overhead display, information as to the common progressive jackpot.

In one type of progressive system, the controller controls the progressive game during each progressive game cycle by first establishing a jackpot-win amount in a random manner between maximum and minimum jackpot values. The controller has an internal random number generator for making this random selection. The controller also establishes a base value which is used as an initial amount for a current progressive jackpot amount, which is the progressive jackpot amount reported by the controller to the machine displays and/or the overhead display and display to the players. The current jackpot amount is recalculated or incremented by the controller each time a game is played at each gaming machine. The controller does this by adding to the current progressive jackpot amount an increment value based on the number of unit bets entered at the individual gaming machines in the progressive gaming system multiplied by a fixed progressive increment rate per unit bet. This is a continuous process since players at different machines are inserting monetary amounts to start game play at different times.

To this end, each gaming machine, as above indicated, reports its unit bet information to the controller upon a player playing the gaming machine so that the current progressive jackpot value can be appropriately incremented. The gaming machine is also identified with conventional signaling to the controller with the bet information so that the controller knows which gaming machine resulted in the increment.

After each increment of the current progressive jackpot, the controller compares the new current jackpot value with the jackpot-win value, which it previously randomly established and stored. If the new value is less than a jackpot-win value, the controller merely updates the current jackpot value and communicates the updated value to the displays at the gaming machines and/or the overhead display. The controller then continues to monitor the unit bet information indicative of game play from the gaming machines and to increment the current progressive jackpot value based thereon.

When an increment to the current jackpot value causes the value to reach or become equal to the jackpot-win value, the controller determines that the jackpot has been won by the gaming machine, which resulted in the aforesaid increment. The controller communicates this to the winning gaming machine and the appropriate payment of the jackpot-win amount is made to the player. This suddenly surprises the player as it comes unexpectedly and adds excitement to the game.

After a jackpot has been won, the controller then institutes a new progressive game cycle in which it resets the progressive jackpot by randomly selecting, from values between the maximum and minimum jackpot values, a new jackpot-win value. The controller then also resets the current jackpot value to the base value and begins incrementing this value based on the fixed progressive increment. As before, this incrementing continues until the current jackpot value reaches the newly selected progressive jackpot-win value and the progressive jackpot is won again. The controller then repeats the progressive game cycle based on continued game play, as described above. The above type of linked random jackpot controller-based systems have been sold by the assignee of the present invention under the trademark MYSTERY JACKPOT and, for example, is discussed in U.S. Pat. No. 5,280,909. The '909 patent specifically teaches that the jackpot payout need not be a fixed jackpot-win value and that the award could be issued based upon conditions at the machine and only paid when the next winning combination occurs at the machine. For example, the payout criteria might be to payout a jackpot equal to the award for the next winning combination established at the machine.

A need exists to improve upon the above progressive gaming system to attract players, to retain players at the gaming machine by extending play, to provide greater unpredictability and to add more excitement in playing the progressive gaming system.

A need exists to provide players with a feeling of group participation as they play a progressive game wherein players are competing against each other in a race for prizes.

A need exists to provide different base values for the start of each game that are random so as to add more unpredictability to the game.

A need further exists to randomly select players for awarding the jackpot so as to attract and retain more players at the game.

A need finally exists to randomly select awards from a weighted payout table so as to add more randomness to the game.

SUMMARY OF THE INVENTION

1. Solution to the Problem.

The present invention solves the above problem by providing improvements to the randomness of the controller-based linked random jackpot system. The improvement is designed to attract more players, to retain players at the gaming machines during extended play, to provide greater unpredictability and to add more excitement in playing the progressive gaming system. The game of the present invention incorporates group participation. When a bonus mode time period is entered eligible players are awarded jackpots of random value in rapid succession creating a frenzied atmosphere for the eligible players. The improved progressive system of the present invention adds more randomness in playing the game, provides jackpot awards of random value in a bonus mode time period of random length, and randomly selects winner machines during the bonus mode time period 2. Summary.

A system and method of operating of a controller-based linked random jackpot system having a plurality of gaming machines wherein each gaming machine generates unit bet information indicative of a number of unit bets supplied to a gaming machine for playing a game. The method includes the steps of randomly selecting a bonus mode value between a high and low limit, providing a current value, and incrementing the current value when the gaming machines are played so that the current value is incremented by a fixed amount of each unit bet received by each gaming machine. The system enters a bonus mode time period when the incremented current value is equal to or exceeds the bonus mode activation value. The jackpot bonus pool is set equal to the bonus mode activation value. The system determines which gaming machines are eligible by locking in all gaming machines that have received a monetary amount within a predetermined time frame after play has started in response to entering the bonus mode time period. The system randomly awards bonus jackpots to randomly chosen eligible gaming machines during the bonus time period. The system randomly selects which eligible gaming machines are to receive bonus jackpots and randomly selects the bonus jackpots from a weighted payout table. Each bonus jackpot decrements the pool by the amount of each jackpot and the bonus mode time period is ended when the jackpot bonus pool is less than or equal to zero.

BRIEF DESCRIPTION OF THE DRAWINGS

FIG. 2 is the functional block diagram of the linked random jackpot gaming system of the present invention incorporating bonus mode time period jackpots.

FIG. 7 sets forth a second operating environment embodiment incorporating the system of the present invention implemented in a circular frame with audio, visual and graphics displays.

FIG. 9 sets forth a block diagram of the system of the present invention interacting with an audiovisual display system.

DETAILED DESCRIPTION OF THE INVENTION

1. Prior Art.

Figure 1:
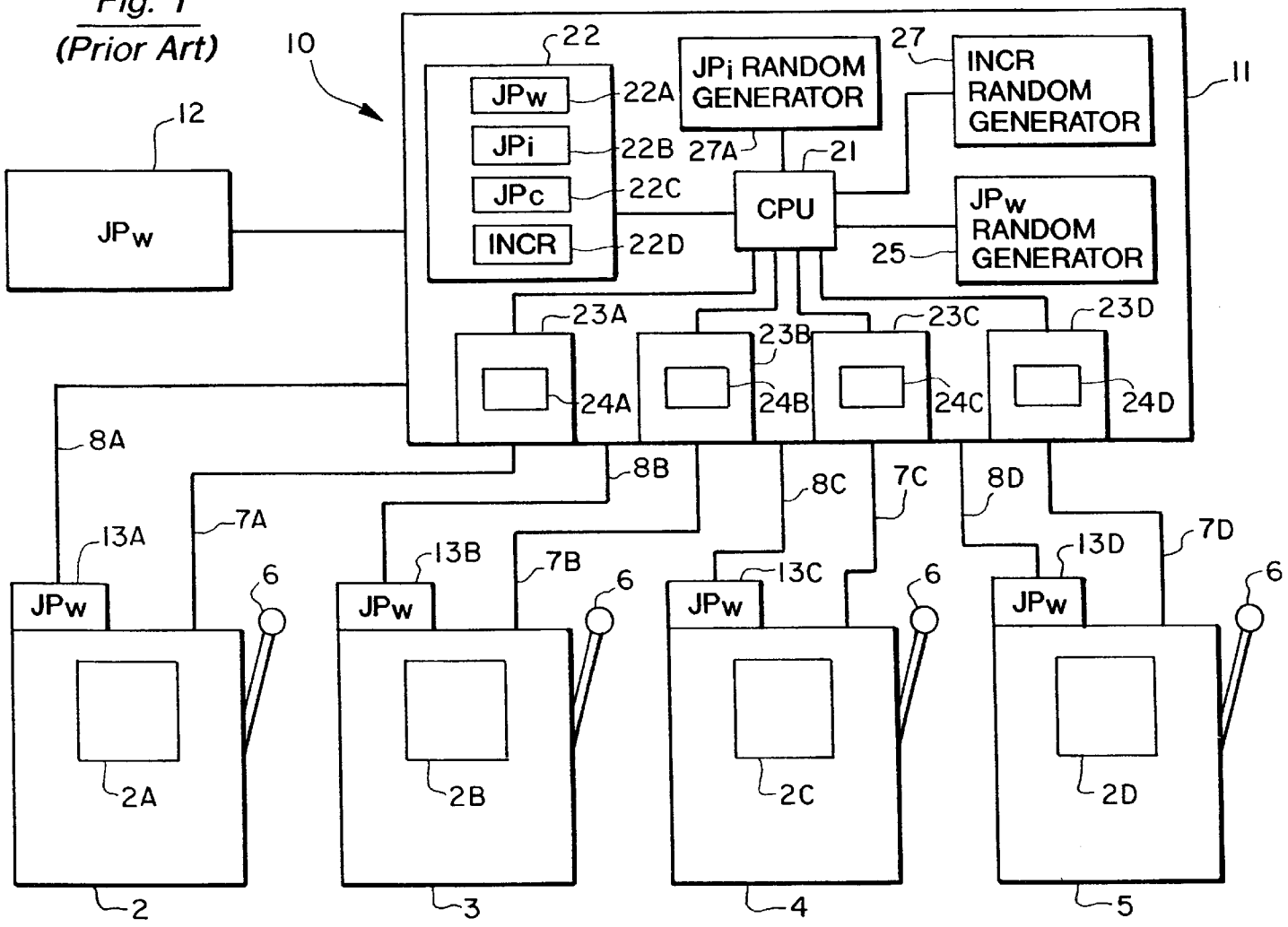
Fig. 1 (Prior Art)
FIG. 1 is the Prior Art system block diagram from U.S. Pat. No. 5,280,909.

FIG. 1 sets forth a prior art linked random jackpot system from U.S. Pat. No. 5,280,909. The following is an adaptation of the teachings of the '909 patent. However, it is to be understood that any conventional progressive controller could be adapted to the teachings of the present invention and the preferred embodiment of the present invention uses the SUPER or SUPREME controller available from Mikohn Gaming Corporation, 1045 Palms Airport Drive, Las Vegas, Nev. 89119.

The present invention is not limited to the type of controller, or type of gaming machine or the type of communication (media), as the invention is functionally described later. Any type of gaming machine that receives bets in order to play a game at the machine is contemplated to be used under the teachings of the present invention including devices such as slots, video games of all types, live card games with tables interfacing with electronic equipment, internet and/or networked games, etc.

FIG. 1 shows a plurality of conventional gaming machines 2, 3, 4, and 5, which are adapted for use with a conventional progressive gaming system. Each of the machines is a reel type slot gaming machine having reels 2A, 2B, 2C and 2D, respectively, and the same unit bet, such as $0.25. It is to be expressly understood that the unit bets and/or monetary value can be in any form to activate a gaming machine such as, but not limited to: coins in, credit play, paper money in, cards in, tickets in, values downloaded over a network, etc.

In normal use, a number of unit bets are inserted into a gaming machine and, depending upon the number inserted, the player plays for one or more awards or payouts. These awards or payouts depend upon certain winning combinations being displayed by the respective reels of the gaming machine when the game is played and as determined by an internal pay table.

Each unit bet applied to a gaming machine is converted into an electrical pulse or signal to signify that the unit bet has been applied. The gaming machine then knows by the number of pulses generated which awards or payouts the player is playing for. In many conventional controllers the unit bet information is serially digitized.

Initiation of a game cycle on each gaming machine begins when the player pulls the machine handle 6, causing the respective reels to spin and stop at certain combinations which are displayed to the player. How a game cycle on a gaming machine is initiated is immaterial to the teachings of the present invention. Game cycles can be started by pulling a handle, pushing a button, playing a hand, automatic start, etc. If the combinations developed are those for which an award or payout is to be made, the gaming machine provides the payout, which is usually some multiple of the unit bet.

In order to stimulate play on the gaming machines 2–5, a progressive jackpot system 10 is utilized. The prior art progressive system of FIG. 1 enables the players playing on gaming machines 2–5 to compete for an additional jackpot which is reached as a result of game play at the machines, but which is not won based upon winning at the machines. As shown, the system 10 includes a programmed controller 11 which links gaming machines 2–5 and which establishes and controls the progressive jackpot. The prior art system also includes a common display 12, as well as individual displays or meters 13A–13D, located at the gaming machines, all of which display the same jackpot information received from the controller 11 on lines 8A–8D, respectively.

In the '909 patent, the controller 11 includes a central processing unit (CPU) 21, a memory 22 and communication interfaces 23A–23D, which include storage buffers, or registers 24A–24D. The latter interfaces receive and transmit information from and to lines 7A–7D, which are connected to the gaming machines 2–5. The lines 7A–7D and corresponding interfaces 23A–23D serve as identification to the controller 11 that the information being received is attributable to a particular gaming machine.

The controller 11 also includes a jackpot-win value generator 25, which establishes the jackpot-win value, $JP_w$, for the jackpot of the progressive system. In the '909 patent, the generator 25 is a random number generator, which randomly establishes in standard fashion the value $JP_w$, from between maximum and minimum jackpot values JPmax and JPmin.

The jackpot-win value $JP_w$ is stored in a register 22A of the memory 22 for use by the controller 11 during game play on the machines to establish whether the progressive jackpot has been won. Also stored by the controller 11 in registers 22B, 22C and 22D of the memory 22 is a base or initial jackpot value, $JP_i$, a current jackpot value, $JP_c$ and an increment per unit bet value, INCR, all of which are also used in determining whether the progressive jackpot has been won. At the start of each progressive game cycle, the value of $JP_c$ is set to $JP_i$.

As fully discussed in the '909 patent, the controller 11 increments $JP_c$ with contributions from each machine 2–5 as monetary values are inserted. When $JP_c \geqq JP_w$, a win exists and the particular gaming machine whose incremental contribution caused the win is identified as the winner and wins the jackpot.

The above discussion closely parallels the prior art controller and the operation of the progressive game discussed in the '909 patent. While the present invention represents an enhancement on the '909 system, it is to be expressly understood that the controller of FIG. 1 is discussed by way of example. As mentioned, any conventionally available progressive controller could be adapted under the teachings that follow.

2. Overview of Present Invention.

The present invention improves upon the prior art system of FIG. 1. In FIG. 2, the functional operation of the present invention, which can be implemented in a conventional controller 200, network 202, and gaming machine G configuration, is set forth.

The controller 200 of the present invention provides three areas of randomness that are not found in the '909 patent. First, a more random game start is provided. The bonus mode trigger function 210 of the present invention is similar in operation to the operation of memory 22, CPU 21, and $JP_w$ random generator 25 in the '909 patent. However, in the bonus mode trigger function 210, the initial value of the current value 220 at the start of each new game cycle is indeterminate. This is in contrast to '909 approach wherein $JP_c$ was set equal to a base value. Hence, an additional element of randomness is injected in the system of the present invention since the initial current value 220 is unknown and indeterminate from game to game. Only on system start-up is a base used as in the '909 patent. Second, a number of randomly selected eligible machines are awarded bonus jackpots for an indeterminate length of time. Only eligible machines are entitled to receive bonus jackpots during this bonus award time period and those eligible machines are randomly selected by random player selector process 270. Third, the random award selector process 292 awards bonus jackpots of random value based upon a weighted payout table 294 located in the controller. Each of these elements of randomness will be discussed hereinafter.

3. Random Start.

In FIG. 2, a high limit 212, a low limit 214, as well as a base value 216 are provided in function 210. A randomly chosen bonus mode activation value or trigger 218 is also provided. The current value is shown as 220. The high limit 212 and the low limit 214 are set to any suitable value by the operator of the system. The base is preferably set to zero or any suitable amount also by the operator. For each bonus mode game cycle of the present invention, a new bonus mode activation value 218 is randomly chosen which is similar to the teachings of the '909 patent. The current value 220 is then incremented in a fashion described above for the '909 patent when each gaming machine is played. Functions 212, 214, 216, 218, and 220 can be either software based or actual hardware registers. In the preferred embodified, the controller 200 is programmed and these functions exist in associated memory.

In FIG. 2, an island 230 of gaming machines G is provided. In the preferred embodiment, these gaming machines G are referred to as G1, G2, . . . Gk. Any suitable number of gaming machines G could be used under the teachings of the present invention. In the preferred embodiment, the gaming machines are generally arranged in concentric circles where k is typically 40 or any suitable number. As shown in FIG. 2, and by way of example, players P are playing gaming machines G1, G3, G4, G6, G8, G9, G10, and G12. It is to be expressly understood that while this example shows individual players playing individual gaming machines, that it is common for a single player to play more than one gaming machine G. The remaining gaming machines (i.e., G2, G5, G7, G11 and Gk) are not being played by players in this example.

Throughout this description, an ongoing example involving players P1, P3, P4, P6, P8, P9, P10, and P12 will be used with respect to the above configuration of players and gaming machines. The purpose of this example is to illustrate the operation of the present invention. It is not meant to limit the teachings contained herein to the specific configuration shown.

Each gaming machine G has an interface card, not shown, which communicates with the controller 200 over network 202. As illustrated in FIG. 2, contributions are collected, such as is taught by the '909 patent (and is otherwise conventional) by function 240 from each gaming machine G that is being played by a player P. In other words, a fixed increment rate from the monetary value inserted by a player P into a gaming machine G is collected and is used, as is shown by line 242, to increment 244 the current value 220. This increment function 244 causes the current value 220 to increase. Hence, as players P insert monetary value into the gaming machines G, a fixed increment rate is collected 240 from each played machine G and is used to increment 244 the current value 220. It is to be expressly understood that the term "fixed increment rate" could be any suitable "amount" or "percentage" of the unit bet or of the monetary value. Furthermore, the teachings of the present invention are not to be limited to a "fixed" contribution since it is possible that a "variable" increment rate could be used based upon the amount of the monetary value. Finally, it is also possible that players could separately bet in order to participate in the game of the present invention at each gaming machine and that the "increment rate" could be based on such separate side bets.

When the controller 200 determines that the current value 220 equals or exceeds 246 the bonus mode activation trigger 218, the controller 200 starts 248 the "bonus mode time period" of the present invention. The value of the bonus mode trigger 218 is randomly selected by a random number generator, not shown, in the controller 200 to be an integer value between the high 212 and low 214 limits. This prevents anyone, even casino personnel, from having the ability to know exactly when the bonus mode starts 246. The start 248 of the "bonus mode time period" is announced with audio and visual display fanfare as will be explained later.

The contribution 240 collected from the particular gaming machine G causing the current value 220 to increment 244 to equal (or be greater than) 246 guarantees eligibility of that particular gaming machine and causes the bonus mode to start 248.

This is an important feature of the present invention. A single player playing his or her gaming machine upon insertion of monetary value into that machine will have a contribution 240 collected from it which will increment 244 the current value 220 to equal or exceed 246 the bonus mode activation trigger value 218 to start 248 the bonus mode time period. The timing of this is unexpected and comes as a surprise to all eligible players playing gaming machines G when they witness the audio and visual announcement. Hence, the bonus mode time period of the present invention randomly starts in the fashion described above. The value of the jackpot pool is set to equal the bonus mode trigger value 218.

The randomness of this start is even greater than that taught in the '909 patent. The initial value for the current value 220 of each game cycle is not set to a fixed base value 216, but is set to a value indeterminate to any player and to a value which varies from game cycle to game cycle as discussed next. Upon system start-up, the current value is set to the base value 216. The base value may also be a seed value, if desired by the operator, in which case it would be added to the current value. As will be more fully discussed, the jackpots awarded are always fully funded, as game cycles are played, even though for a particular game, the current value 220 may start negative.

Bonus jackpots are made to one or a number of eligible machines during the bonus mode time period. Each bonus jackpot has a value 298 which is paid 254 to a random winning eligible gaming machine. Each jackpot paid 254 causes the current value 220 to decrement 256. When the current value 220 is decremented 256 to be equal to or less than 258 zero from successive bonus jackpots 298 paid 254 to random eligible winning machines, the controller 200 ends 260 the bonus mode time period. It should be understood that a randomly generated turn-off value other than zero could also be used under the teachings of the present invention.

Under the teachings of the present invention, at the start 248 of each bonus mode game cycle, the system randomly chooses a bonus mode activation trigger 218 between the high 212 and low 214 limits according to any of a number of conventional random number generating programs based in controller 200. Whatever the current value 220 was from the prior bonus mode game cycle is used as the starting current value 220 in the current bonus mode game cycle and is continually incremented 244 by collected contributions 240 from gaming machines G in the new gaming cycle. These incremental contributions cause the current value 220 to equal 246 the bonus mode activation trigger value 218 and the controller 200 starts 248 a new bonus mode time period. The jackpot pool is set equal to the random bonus mode trigger value. During this new bonus mode time period, bonus jackpots 298 are again awarded 254 to eligible machines and each award causes the current value 220 to decrement 256 until it equals or is less than 258 zero in which case the new bonus mode time period ends 260.

The start 248 of the bonus mode locks in the jackpot pool for the entire bonus mode. This jackpot pool is equal to the value of the bonus mode trigger 218. In the preferred operation of the '909 patent, this entire value would have been given to the machine G whose contribution caused the trigger 246 to occur. Under the teachings of the present invention, this trigger value provides the value for a jackpot pool from which the jackpots 298 are deducted 256. Any contributions 240 after the start 248 occurs in the preferred embodiment, are not added to the jackpot pool. If such contributions were allowed, then conceivably one eligible machine could play indefinitely from the pool being funded by the other non-eligible players. The additional contributions go to the new current amount.

In the preferred embodiment, the current value 220 at the end 260 of the prior game cycle of the present invention becomes the basis for the current value 220 of the next game cycle. By setting the prior current value to the next current value this provides a degree of randomness and uncertainty since it prevents players from watching a number of game cycles of the present invention in order to predict when to start playing games so as to enhance their likelihood of winning. The current value 220 at the beginning of a game cycle, corresponding to the current value 220 of the prior game cycle, is unknown and different each time. This will be more thoroughly explained later. This process also guarantees that bonus jackpots are fully financed and never cause the system to operate in the red.

4. Locking-In Eligible Gaming Machines.

In FIG. 2, the player island 230 is represented functionally as two separate configurations, in time (i.e., times $T_1$ and $T_2$) based upon player eligibility. Island 230A shows the configuration of all players P playing gaming machines G at a first time, $T_1$, just prior to the start 248 of the bonus mode time period and island 230B shows the configuration of only the eligible players E playing gaming machines G at a second time, $T_2$, corresponding to the start 248 of the bonus mode time period. Not all players P playing the conventional game at the gaming machines G become eligible players E. In the example shown in FIG. 2, players P6 and P12 do not become eligible players, at time $T_2$, and their gaming machines G6 and G12 are ineligible. Whether a player is eligible to play the bonus game or not depends on the controller locking in 262 eligible machines G so as to participate in the controller-based bonus mode game of the present invention. It is to be expressly understood that the locked-out (or ineligible) machines G could still be conventionally played. In FIG. 2, the example shows only machines G1, G3, G4, G8, G9, and G10 to be eligible and locked in 262 at time $T_2$.

Figure 3A:
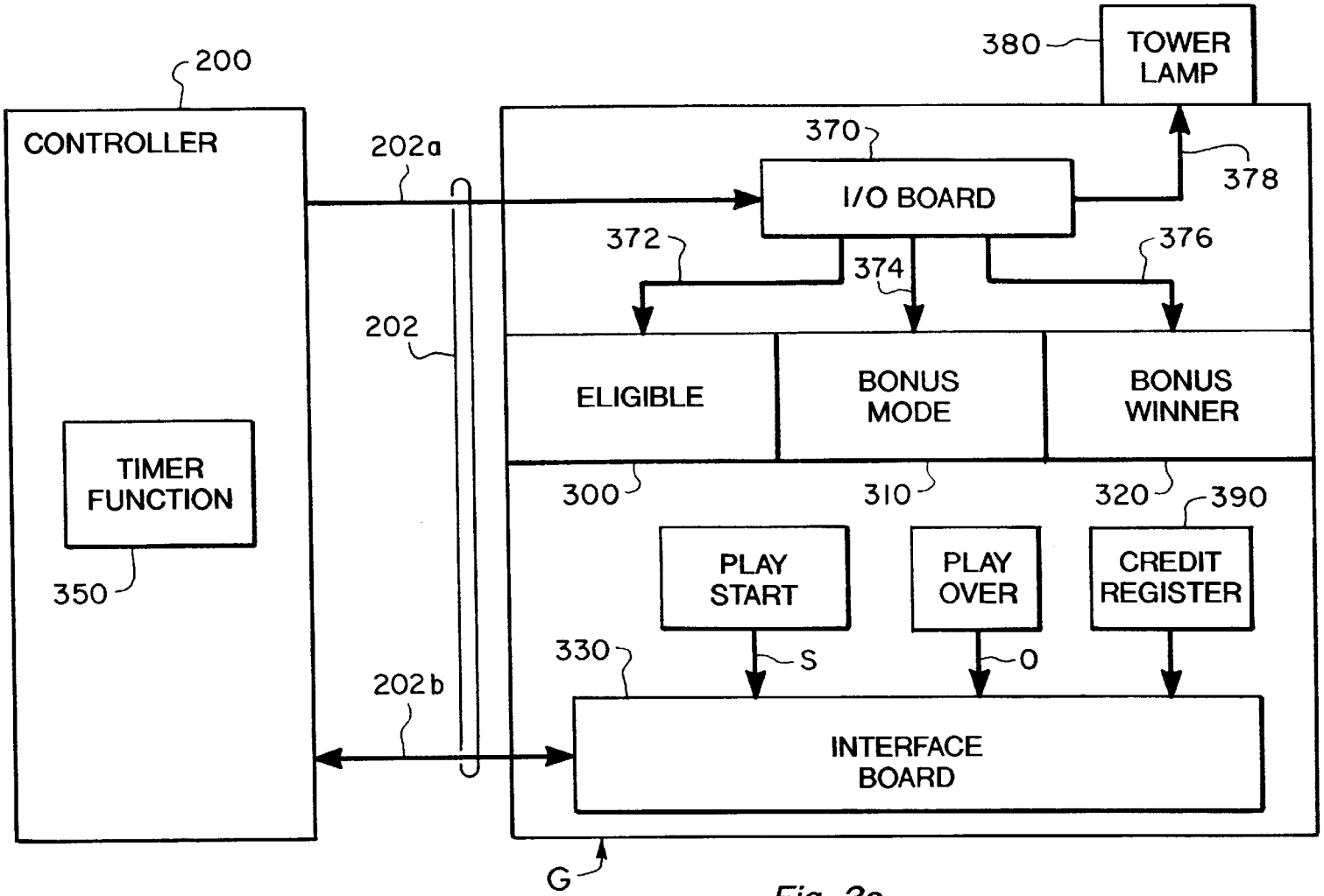
FIGS. 3*a* and 3*b* set forth the interface with a gaming machine.

In FIG. 3*a*, a conventional gaming machine G is modified to have three indicators 300, 310 and 320. Indicator 300 conveys an eligibility message to a player, indicator 310 conveys when the bonus mode time period is activated and indicator 320 conveys a bonus winner message when an eligible machine receives a bonus award. It is to be expressly understood that indicators 300, 310 and 320 could be of any type such as visual displays, audible indicators, or a combination of both which could be incorporated into a machine, on a machine, or near a machine as a single display or as multiple displays. A single display could be used such as a digital display to exhibit all three indicators rather than having separate displays. In the preferred embodiment, backlit slot glass is used. The type of indication is immaterial to the teachings of the present invention.

The messages conveyed by indicators 300, 310, and 320 are important. It is important that an eligible player E be continually aware of eligibility status with indicator 300. It is also important than an eligible player E is immediately informed of when a bonus mode time period is started 248 (and ended 260) with indicator 310 and to be immediately informed when he or she receives a bonus award 254 with indicator 320. These indicators 300, 310, and 320 are oriented to be in a position such that the eligible player can easily receive the desired message. This may be accomplished by turning lights on, flashing lights, sounding alarms, etc.

Within each gaming machine G are conventional signals indicating start of play S in the gaming machine and a play over signal O when the game being played in a machine is over (and whether the player has won or lost the game). These signals are conventionally delivered over a network 202*b* to the controller 200 of the present invention.

Figure 4:
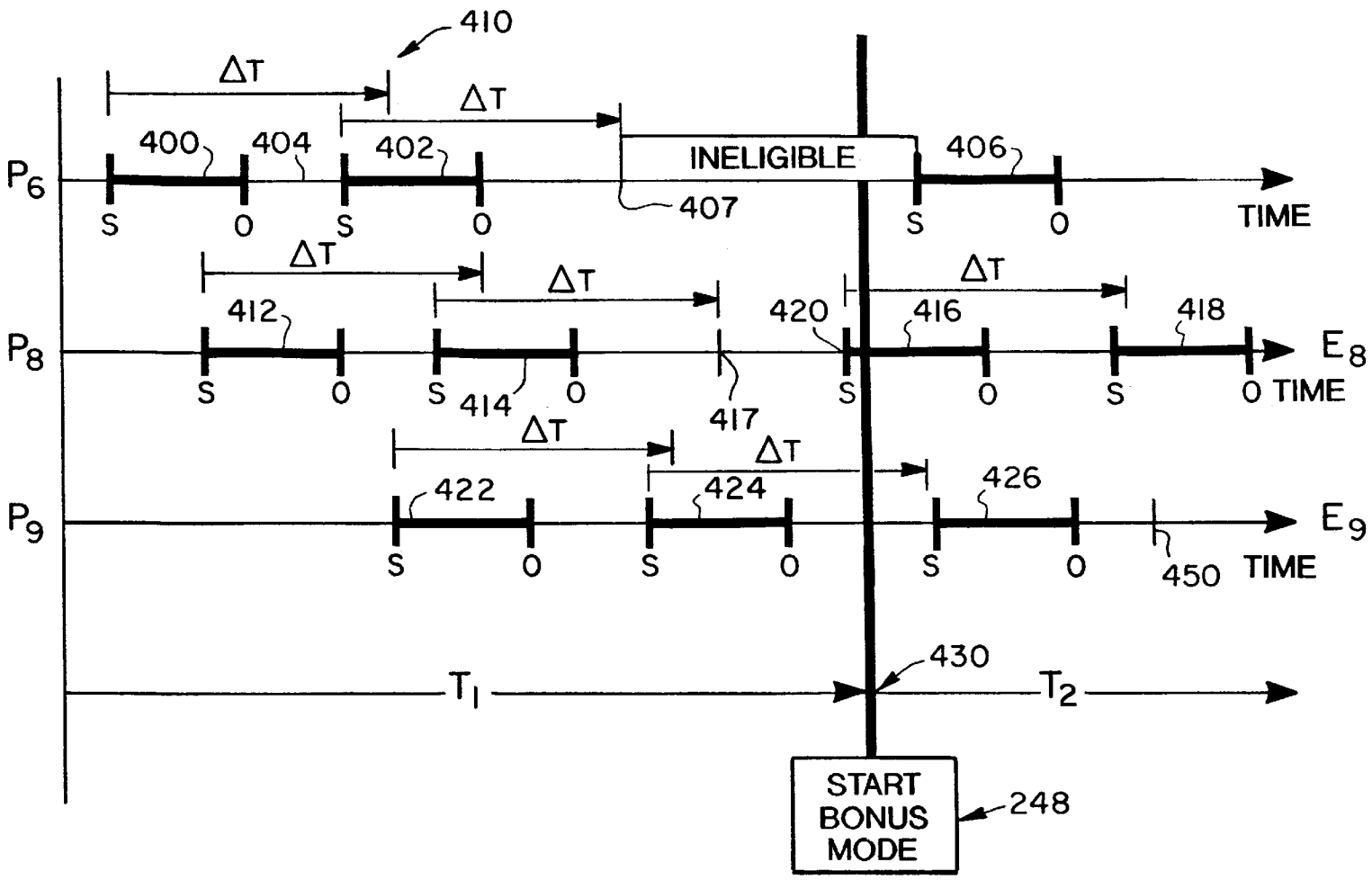
FIG. 4 sets forth the timing, in an example of three players, for establishing player eligibility.

Under the teachings of the present invention, a timer function 350 in controller 200 (which can be computer generated) receives the play start signal S from the interface board 330 over network 202*b*. The timer function 350 continually determines player eligibility and activates indicator 300 as a player starts S play at a gaming machine and for a ΔT time period thereafter. FIG. 4 is an illustration of several game play sequences corresponding to the players P at machines G illustrated in FIG. 2. The timer 350 could also be located at the I/O board 370 to control eligibility.

In FIG. 4, the determination of player eligibility is illustrated with respect to FIG. 2 for the on-going example. Players P6, P8 and P9 of FIG. 2 have their gaming activity at gaming machines G6, G8, and G9, respectively shown. Player P6 sitting at game G6 during time interval $T_1$ (i.e., configuration 230A) plays two games 400 and 402. The start S of each game is shown as well as when the game is over O. Between game plays 400 and 402 is an interval time 404 during which player P6 inserts a monetary amount in the form of unit bets. The time period 404 is variable depending on the desires of the player. It is this variability that is important under the teachings of the present invention. Player P6 can then play the game (for example activating handle 6 in the '909 patent).

It is to be understood that under the teachings of the present invention, the controller 200 determines the eligibility of the gaming machine by continually sensing a predetermined time frame ΔT after game play has started S. The game play referred to herein is the game at the gaming machine such as, for example, slots.

As shown in FIG. 3*a*, when a gaming machine G generates the play start signal S, the interface board 330 in a conventional manner (such as when polled) delivers this to the controller. A timer function 350 in controller 200 is activated which causes a predetermined time period ΔT to time out after game start S. This ΔT time period is predetermined and is fixed, although the amount of time can be set by the operator of the controller 200 of the present invention to any predetermined value. In the preferred embodiment, this time period is typically in the range of 8–15 seconds. Typically, a reel-type slot game is played in four seconds. Referring back to FIG. 3*a*, the game start signal S from the gaming machine activates the timer function 350. Controller 200 over network 202*a* causes indicator 300 to be activated over line 372 thereby informing the player that the player is eligible for the bonus mode. The eligibility indicator 300 continues to stay on for a ΔT time period after the game start signal S is detected. During the ΔT time period 410, as shown in the example of FIG. 4, the start signal S is detected by the controller 200 from player P6 as the player P6 starts playing game 402 which restarts the ΔT time period. Player P6 then completes game 402. However, as shown in FIG. 4, the player P6 does not start S the next game 406 within the prior ΔT time period so that the start signal S for game 406 occurs after the prior ΔT time period expires. Hence, at time 407, the eligibility indicator 300 is deactivated by the controller 200 and player P6 is no longer eligible. Eligibility for player P6 occurs only when the controller 200 receives the start signal S for the next game 406 within the prior ΔT time period. This did not occur for player P6. As shown in FIG. 4, player P6 has a period of time (i.e., between time 407 and the start S of game 406) in which the player P6 is ineligible to play in the bonus mode of the present invention.

Player P8 is shown in FIG. 4 playing four games, 412, 414, 416, and 418 on gaming machine G8. Player P8 remains eligible during games 412 and 414 since player P8 starts S game 414 within the predetermined ΔT time period after the prior game 412 is started S. However, as shown in FIG. 4, player P8 fails to start S game 416 within the ΔT time frame after game 414 is started S. Hence, at time 417, the eligible indicator 300 for gaming machine G8 is deactivated by the controller 200. This immediately informs player P8 that he or she is no longer eligible to play in the bonus mode time period should it occur. Player P8 starts S game 416 at time 420. This restarts the ΔT time period. At time 420, the eligible indicator 300 is reactivated and the player is again eligible for the bonus mode. Note that player P8 starts S game 416 at time 420. Under this example, it is the entry of the monetary value by player P8 into gaming machine G8 for game 416 that causes the current value 220 to be equal 246 to the bonus mode activation trigger 218. The receipt of the monetary value bet by player P8 at gaming machine G8 is sensed by the contribution function 240 of the controller 200 and the controller 200 increments 244 the current value 220 which now causes the start 248 of the bonus mode time period at time 430. The bonus mode start 248 function causes an eligibility lock 262 to occur which locks in those machines that are eligible. An eligible machine is a machine that is within the ΔT time period at the time of bonus mode start 248. When the bonus mode starts 248, the controller 200 determines eligibility and those machines that have their eligible indicators 300 activated are eligible when the bonus mode time period is started 248. Player P6, in this example, is not eligible at time 430 and is locked-out of the bonus mode play although he or she can still play a number of conventional games on machine G6 such as game 406.

One of the features of the present invention is to announce at time 430 to persons in the area of the island 230 and to all players at all gaming machines contained therein that the bonus mode has been entered. This is usually done by audio sounds such as music, visual indicators such as flashing lights or the lighting of lights and the like. The purpose of such celebration (visually and audibly) is to attract other persons in the vicinity of the island 230 to witness the distribution of numerous bonus jackpots during the bonus mode time period. This will be discussed later.

Each player P at a gaming machine G during time $T_1$ always knows whether or not they are eligible since their eligible indicator 300 is activated. With respect to the example in FIG. 4, player P6 knows that she has lost eligibility since her eligible indicator 300 is not activated at time 407 well prior to time 430. Even though player P6 starts S game 406 by entering a monetary value, her gaming machine G6 will be locked out from the bonus mode by function 262. This is an important feature of the present invention since it is a goal of the present invention to reward eligible players who promptly continue play of their gaming machines within the predetermined ΔT time frame 410 after each game is started S. Eligibility is important since it allows those players who promptly play their machines to be entitled to the bonus jackpots during the bonus mode time period. Eligibility is also important to stop slot cheats. Hence, player P6 and with reference back to FIG. 2, player P12 at time 430 are rendered ineligible at time $T_2$ even though they can continue to play the conventional game on their machines. The other unplayed gaming machines are also locked out such as G5 and G7. Players can sit and commence play at those machines during the bonus mode time period, but are not eligible for the bonus jackpots. The eligible players at time $T_2$ in FIG. 2 are termed E1, E3, E4, E8, E9 and E10 and only their respective gaming machines G1, G3, G4, G8, G9, and G10 are allowed to participate in the bonus mode time period. All of the other gaming machines can be conventionally played in the configuration 230 but are locked-out and cannot participate for bonus jackpots.

Note that player P8 is the player who upon insertion of the monetary amount into his or her gaming machine G8 caused the controller 200 to start 248 the bonus mode. However, in the preferred embodiment, player P8 does not receive an award or prize or other types of jackpot for causing this event to happen. In the preferred embodiment, all eligible players are locked in for the duration of the bonus mode.

Player P9 plays gaming machine G9 as shown in FIG. 4. Player P9 starts S her first game 422 and then starts S the play of her second game 424 before the expiration of the ΔT time period. The eligible indicator 300 for machine G9 remains activated for the ΔT time period for the second game 424 even though player P9 has not started S game 426 until after time 430. Player P9 becomes an eligible player and her gaming machine G9 is locked-in.

To summarize at time 430, gaming machine G6 is not eligible and is locked-out whereas machines G8 and G9 are eligible and locked-in. During the bonus mode time period $T_2$, all eligible machines in the preferred embodiment remain eligible whether or not a player starts the next game within a predetermined time frame ΔT after the prior game. Hence, player P9 could walk away from gaming machine G9 at time 450. Another person can sit down at eligible machine G9 and continue to play in the bonus mode time period. During the bonus mode time period (from start 248 to end 260), both indicators 300 and 310 are activated. Other embodiments of the present invention could require eligibility to be maintained during the bonus time period. For example, the ΔT time periods could be maintained so that if a player did not start S a game within the ΔT time, the machine would lose the right to continued participation in the bonus mode. Or, in another example, the eligible players could be required to always place maximum bets and should other than a maximum bet be placed the right to continued participation in the bonus mode would be lost. Or, the aforesaid examples could be combined.

Once the bonus mode time period has been started 248 at time 430, all eligible machines are locked in and only those machines are entitled to bonus jackpots during the bonus mode time period. Both eligible and ineligible gaming machines can be played conventionally. It is to be expressly understood that this is a preferred embodiment of using ΔT to determine eligibility at bonus mode start 248 and that variations to determining eligibility could take place. Eligibility can be based upon other conventional conditions at the gaming machine such as the insertion of a player tracking card, in which case eligibility is lost when the card is removed. Hence, at bonus mode start all machines having player tracking cards inserted are eligible. Eligibility could also be determined by requiring all players bet maximum bets during the ΔT time frame.

In summary, gaming machine eligibility (therefore, player eligibility) is determined by the controller 200 of the present invention by locking-in only those gaming machines that are currently within a predetermined time period ΔT after a game is started S. This determination could also be made by locking out those gaming machines that are ineligible.

It is to be expressly understood that the preferred embodiment provides a ΔT time period commencing from the start S of a game. However, the ΔT time period could also be measured starting from when a game is over O. In which case, eligibility is determined from sensing O to the end of the ΔT time period. Furthermore, the timing function could be located in the interface board 330 at each gaming machine G rather than in the controller 200.

In FIG. 2, the eligible players E operating eligible machines in time $T_2$ can continue to play both the conventional game at the gaming machines and also participate in the bonus mode time period. The remaining players such as P6 and P12, who are not eligible, can still play the conventional game and players can operate the other ineligible machines (e.g., G2, G5, G7, and G11) in conventional fashion.

Figure 3B:
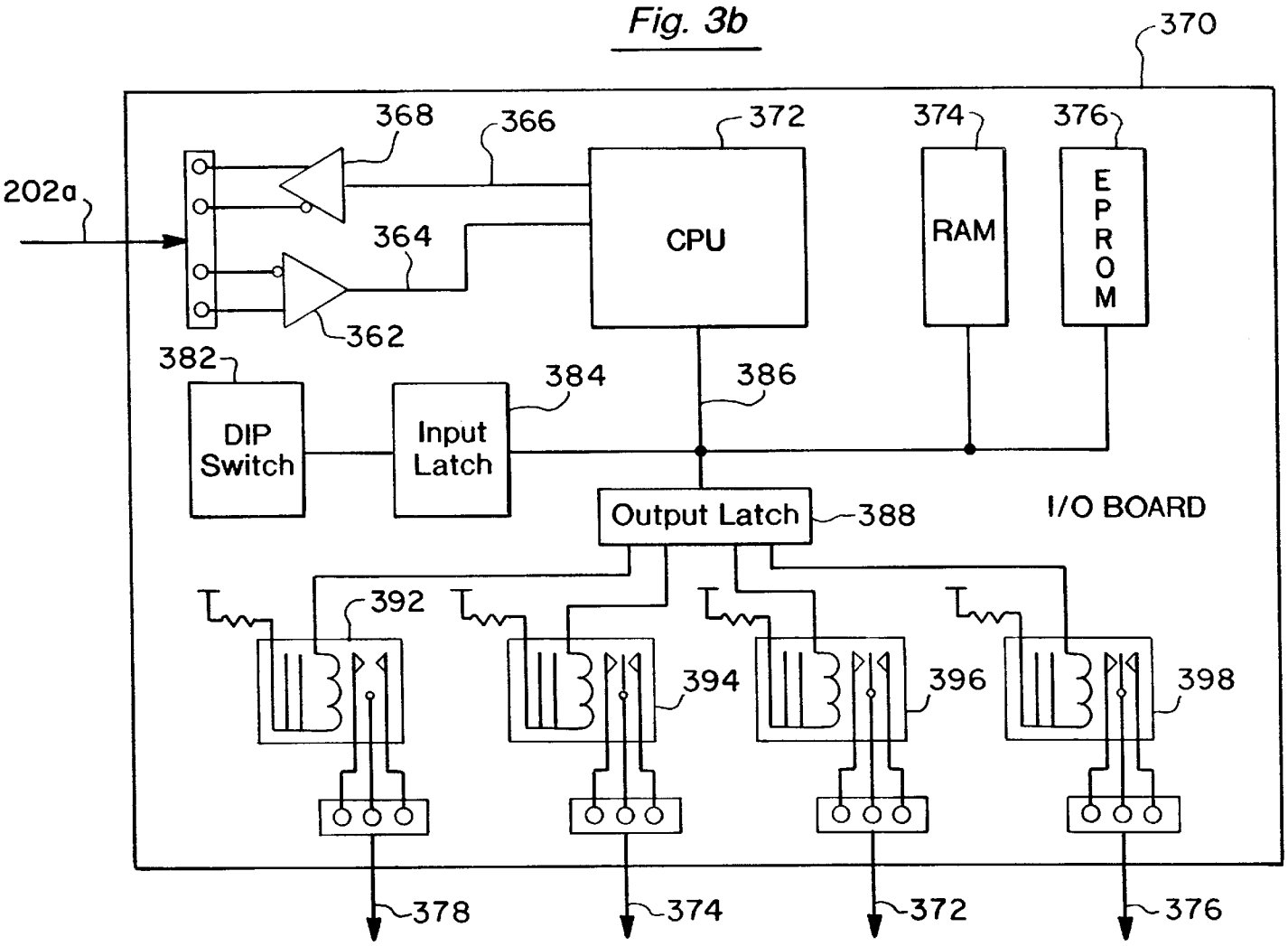

FIG. 3*b*, sets forth the details of the I/O board 370, which is interconnected over network 202*a* to the controller 200. In the preferred embodiment, the network connection 202*a* is a serial interface over which serial digital signals are delivered from the controller 200 to the 1/0 board 370 through buffer 362 and over lines 364 to an internal CPU 372. The CPU 372 can communicate over lines 366 and through buffer 368 with controller 200. Communication protocols are numerous and well known in the art for communications between controllers 200 and on board computers 372. On the I/O board 370 is also a random access memory (RAM) 374 and erasable programmable read only memory (EPROM) 376 which are also conventional in the art for storing permanent and temporary programming information to control the operation of the I/O card 370 and to effectuate communication between the controller 200 and the CPU 372.

Also on board 370 is a DIP switch 382, which is interconnected to an input latch 384 and communicates with the CPU 372 over bus 386. The CPU also communicates over the bus 386 with the RAM 374 and the EPROM 376 as well as an output latch 388. The purpose of the DIP switch 382 is to provide a unique code to identify the machine G at which the I/O board 370 is located. The CPU 372 provides this unique machine code in its communications to and from the controller 200.

The output latch 388 is interconnected to relays 392, 394, 396 and 398 which are utilized to drive respectively, tower lamp 380 over lines 378, the bonus mode indicator 310 over lines 374, the eligible indicator 300 over lines 372, and the bonus winner indicator 320 over lines 376. The above represents only a preferred embodiment and, it is to be expressly understood, that many other equivalent circuit approaches could be utilized to identify the gaming machine and to activate the indicators 300, 310, 320 and 380.

5. Random Selection of Eligible Gaming Machines.

With reference back to FIG. 2, when the bonus mode start 248 occurs the controller 200 issues a bonus mode signal 261 to the eligibility lock function 262 which locks-in the eligible gaming machines. In addition, signal 261 activates a delay trigger function 264 to delay the award of bonus awards by a time period. In the preferred embodiment, this is a fixed time delay. In other words, the purpose of function 264 is to delay the award of any bonus awards by the controller 200 for a short predetermined period of time after the system locks-in the eligible machines and activates the bonus mode indicators 310. The controller 200 of the present invention then determines, on a random basis, which eligible machines are to receive bonus jackpots.

The controller of the present invention 200 must now randomly choose which of the eligible machines will receive the bonus jackpots during the bonus mode time period. In essence, the bonus jackpots are a series of miniature random controller-based jackpots. In the on-going example, an island 230 of FIG. 2 has K machines with eight players playing eight gaming machines. As discussed above, six machines of the eight are eligible (i.e., G1, G3, G4, G8, G9, and G10) to play in the bonus mode at the start 248 of the bonus mode (time 430 in FIG. 4) which is shown as configuration 230B. The system 200 of the present invention uses the random player selector 270 to pick different ones of the six eligible machines on a random time basis for each random bonus award. The controller 200 as shown by dotted lines 272 knows the identity of all eligible machines.

Figure 5:
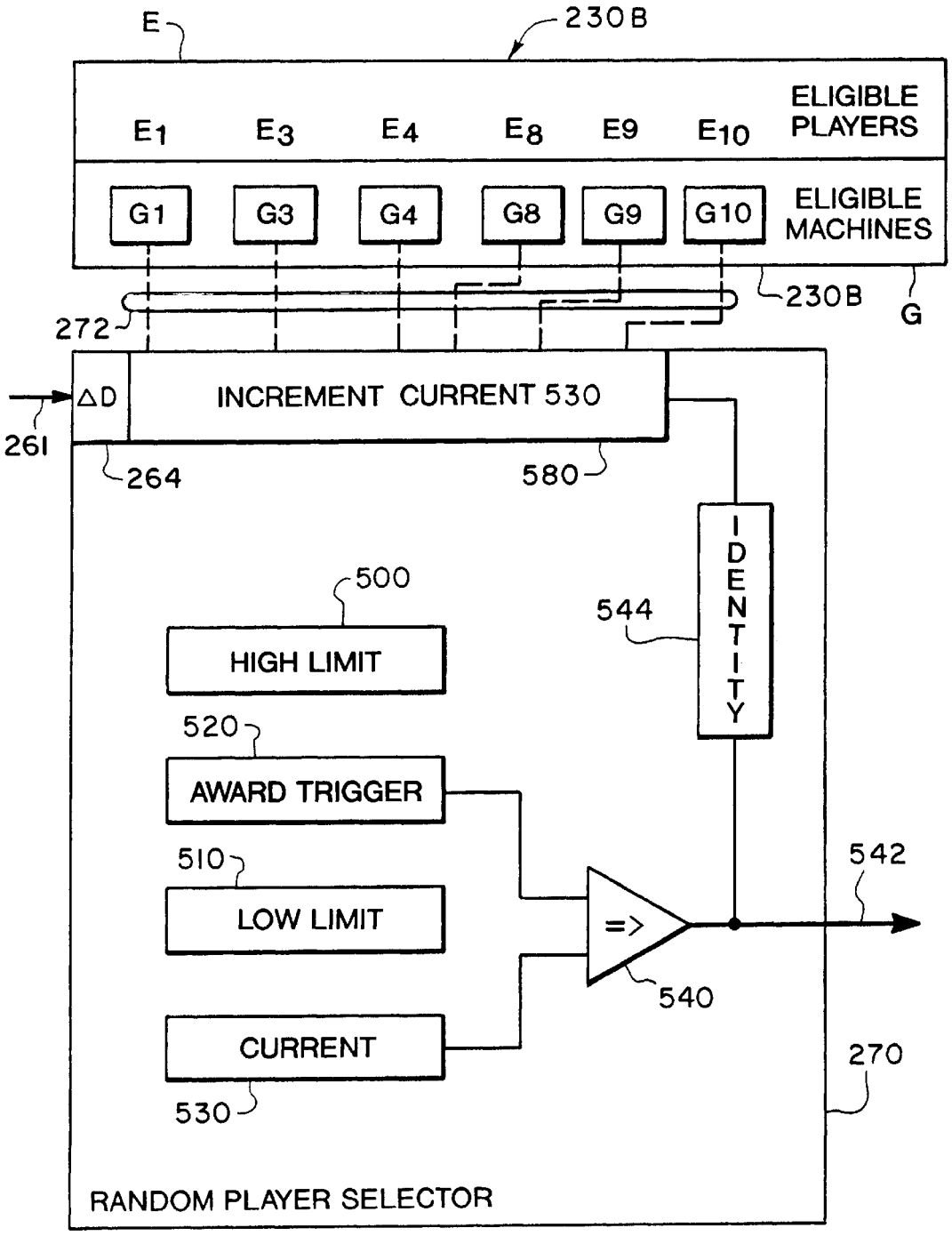
FIG. 5 sets forth the functional block diagram of the random selection of an eligible gaming machine during the bonus mode of the present invention.

FIG. 5 illustrates the functional operation of the random selector 270 in FIG. 2. The purpose of the random selector 270 is to provide the random selection of eligible gaming machines (and therefore eligible players) to award bonus jackpots.

In FIG. 5, a high limit value 500 and a low limit value 510 are provided. Again, these functions can be implemented in software, hardware, or both. In the preferred embodiment, the high limit value 500 is equal to:

J×N×max coin setting.

The low limit value 510 is equal to:

K×N×max coin setting.

The number of eligible machines corresponds to N. In the preferred embodiment J=3 and K=2, although any suitable integer could be used. The "max coin setting" corresponds to the maximum coin setting of the gaming machines G. For the example of FIG. 2, a common dollar reel-type slot machine has three dollar coins for the maximum coin bet. Hence, in the example the number of eligible machines is 6 (i.e., N=6), and the max coin setting is equal to 3, then a high limit value 500 equals 3 times 6 times 3 or 54, and the low limit 510 equals 2 times 6 times 3 or 36. The controller 200 of the present invention counts the number of eligible machines and arrives at the value for N, and then determines the high limit 500 and the low limit 510 in response to the start 248 of the bonus mode time period. These determinations are used by the linked random jackpot controller-based system 200 of the present invention for a single bonus mode time period, but is recalculated for each new bonus mode time period.

The controller 200 of the present invention, using a conventional random number generator located therein, then derives an award trigger 520 randomly between the high limit 500 and the low limit 510. This adds a further randomness to the game of the present invention and ensures fair selection from all eligible players based upon rate of play. The current value 530 in the random selector 270 can be initially set to any suitable value, preferably zero. If set to zero, at the start 248 of the bonus mode (time 430 in FIG. 4), the controller 200 monitors the unit bets from each eligible gaming machine as shown by dotted lines 272 and each unit bet increments 580 the current value 530 by one. It is important to keep in mind that the non-eligible gaming machines may be conventionally played, but the unit bet signals from those ineligible machines are not sensed by the increment current function 580. Only the eligible machines as they are conventionally played, have their unit bets sensed by function 580 to increment the current value 530 in the random selector 270.

When the increment current function 580 commences to start counting the unit bets from the eligible machines is set by the operator of the system of the present invention. Typically, a delay 264 (also termed ΔD), such as 5–10 seconds is incorporated. This is an optional feature. It is to be expressly understood that the increment current function 580 can commence immediately without delay or have a fixed delay 264 set by the operator, or any other suitable determination. The ΔD time period 264 allows the casino to extend the bonus mode time period without costing the house. The ΔD time period 264 also provides a "relaxation period" for the players.

When the current value 530 equals or exceeds 540 the award trigger 520, through incrementation 580, the controller at 542 enters the jackpot winner selection process 290 of FIG. 2. The gaming machine which causes the current value 530 to equal 540 the award trigger 520 is identified 544 and delivered 542 to jackpot winner selection process 290.

Figure 6:
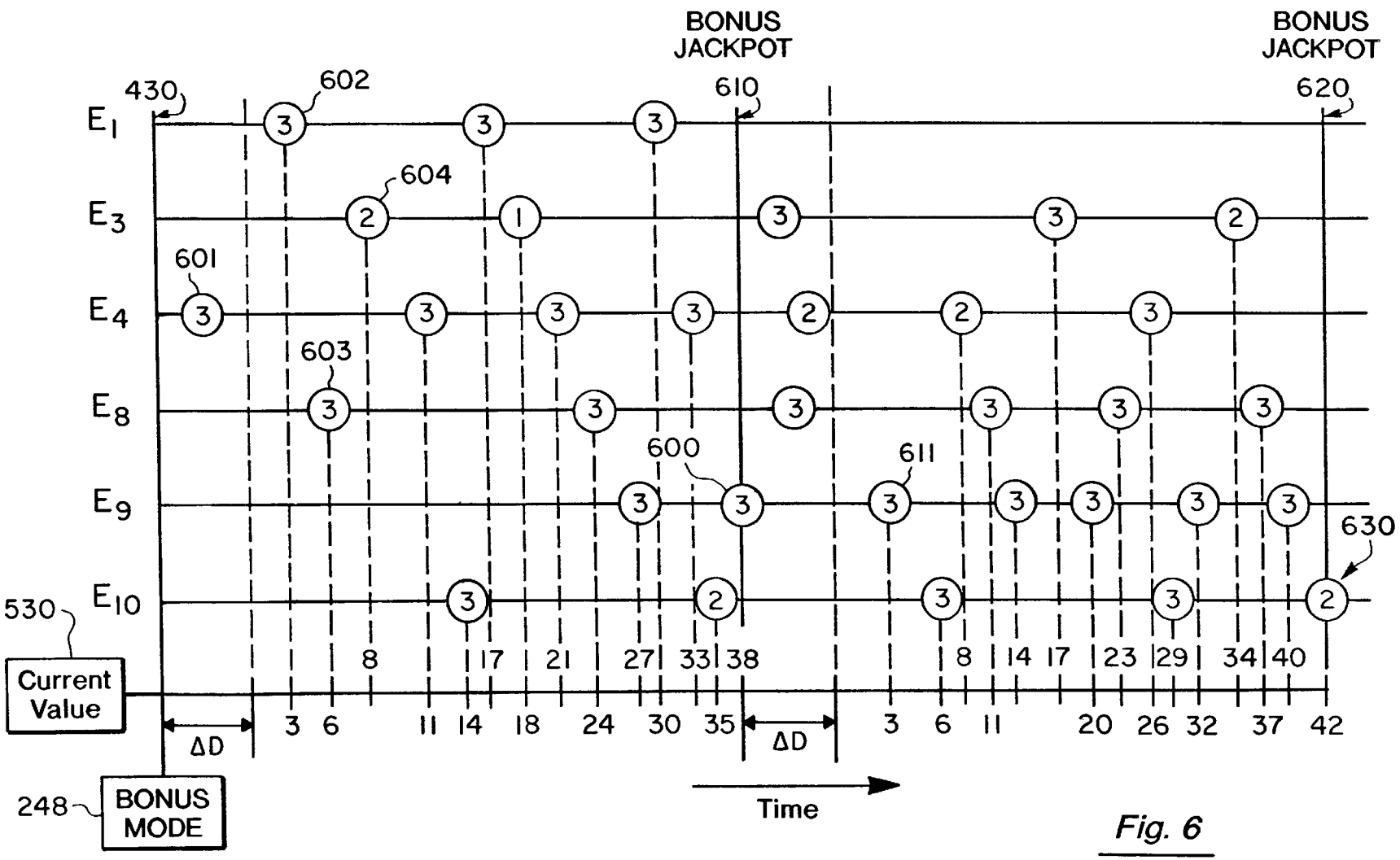
FIG. 6 sets forth the timing among six gaming machines, in an example, of determining which eligible gaming machine receives a bonus award.

This portion of the operation of the controller 200 in the present invention is functionally shown in FIG. 5 with reference to FIG. 6. In FIG. 6, two bonus jackpots 610 and 620 in a bonus mode time period starting at time 430 are issued to randomly selected eligible machines. FIG. 6 further illustrates the operation of the present invention with the on-going example. The bonus mode start signal 261 is issued at time 430 and with reference back to FIGS. 2 and 5, the following are the eligible machines: G1, G3, G4, G8, G9, and G10 being played by eligible players E1, E3, E4, E8, E9 and E10. At time 430, there are six eligible players (N=6). As previously discussed, the high limit 500 equals 3 times 6 times 3 or 54, and the low limit 510 equals 2 times 6 times 3 or 36. The controller 200 using a random number generator randomly picks the value for the award trigger 520 between 36 and 54. In the example shown in FIG. 6, the first randomly selected award trigger equals the value of thirty-seven. The controller 200 sets the current value 530 to zero at time 430.

Under the teachings of the present invention, during a first ΔD delay time 264, any unit bets made by eligible players E are ignored. Hence, player E4 at machine G4 has placed a three-dollar bet 601 and the unit bets of three are not counted. Counting commences after the ΔD delay and the first three-dollar bet 602 by player E1 is counted and is shown on the current value 530 line as 3. Next player E8 places a three-dollar bet 603 so the current value 530 is now 6 due to the operation of the increment function 580. Next, player E3 places a two-dollar bet 604 and the current value 540 equals 8, and so on. One player, E9, subsequently at time 610, makes a three-dollar bet 600, the current value 530 now equals 38 which equals or exceeds 540 the award trigger value of thirty-seven, thereby causing a signal 542 to be issued from the random player selector 270 to the jackpot winner selection process. The eligible machine G9 is identified 544 by the controller 200 as being responsible for the issuance of signal 542. As will be described subsequently, gaming machine G9 will automatically 254 receive a bonus jackpot.

The system 200 enters the second bonus jackpot round at time 610. During the ΔD delay period unit bets from eligible players E3, E4, and E8 are not counted. Counting starts with eligible player E9, making a three-dollar bet 611. In this second bonus jackpot round, the high and low limits 500 and 510 remain the same. The controller 200 selects a new random value for the award trigger 520, which, in this example, is forty-two. The current value 530 is reset to zero. Hence, the process repeats with the increment current function 580 continually adding each unit bet to the current value 530. When machine E10 at time 630 inserts two dollar coins, the current value 530 equals the award trigger 520, signal 542 issues, and the system 200 identifies eligible gaming machine G10 as winning the second bonus jackpot.

In this fashion, each bonus jackpot during the bonus mode time period is randomly, in time and through play, given to one of the eligible machines. What that machine is and when the award will be given is indeterminent and random. When a bonus jackpot is given, and with reference back to FIG. 3, bonus winner indicator 320 of the winning eligible machine is activated to inform that eligible player of winning a bonus jackpot. In addition, other indicators, such as a tower lamp 380 on top of the eligible machine may also be activated to flash so that people witnessing the game and other players can see who won the bonus award. Indeed, under the teachings of the present invention, an announcement may be made to all within the vicinity of the island 230 that a bonus jackpot has been given so that people can see which player receives the bonus jackpot.

While the above represents a preferred approach to randomly selecting a player for a bonus jackpot, it is to be expressly understood that any of a number of equivalent ways could be use. The preferred embodiment, however, adds excitement and incentive for an eligible player to continually play the maximum number of coins (i.e., unit bets) as fast as each game can be played. Even though the player selection is random, both in time and in identity, playing the maximum coin insert rather than a single coin insert and playing as rapidly as possible, increases the odds that that player may be the player to bring the current value 530 equal to the award trigger 520. It is to be understood that the use of "counting coins" is for illustrative purposes only and that, as mentioned, the monetary value can be inserted (or actually in the machine) in any one of a number of conventional approaches.

Clearly, if a player E who is eligible sits at an eligible gaming machine G, and does not place any unit bets, that player will never be selected to receive a bonus jackpot. All eligible players who conventionally play, however, have a sense of group participation. They are in a race against each other to quickly place bets so as to be selected for the bonus jackpots.

It is important to note that the controller 200 counts the unit bets in making the random selection 270. Hence, whether the controller 200 is counting the unit bets of one dollar or units bets of twenty-five cents is immaterial. It is the count of the unit bet that occurs in the preferred embodiment not the actual value. However, it can be appreciated that the same approach as discussed for triggering the bonus mode (i.e., contributions based upon entry of monetary amount) could be used to make the random selection.

Note that is possible that two players may simultaneously bet, but the controller 200 awards only one bonus award when that occurs. In the preferred embodiment, and as shown in FIG. 2, poller 255 sequentially polls each machine to receive the unit bet information. Hence, in the case of bets placed simultaneously by players at gaming machines G, only one player (i.e., the first player to be polled) is selected when that player's bet causes function 540 to become activated.

In summary, it can be observed that the bonus awards are randomly made by the controller-based system 200, both in time and in selection of the gaming machine. Eligible players at the gaming machines cannot predict when and who will be awarded a bonus award. The approach set forth with respect to FIG. 6 is the preferred approach for randomly selecting an individual eligible gaming machine for a bonus jackpot.

As with FIG. 2, FIG. 5 is neither a schematic or a software flow chart. FIG. 5 is a functional presentation showing the operation of the controller. As such, the components (such as 580, 510, etc.) and the interconnecting lines (such as 542) are part of the functional operation which are to be implemented into a conventional CPU and its associated memory and communications packages.

6. Random Selection of Bonus Awards.

In FIG. 2, a random payout selector 292 in the controller 200 is disclosed using a weighted payout table 294. The random payout selector 292 randomly selects, in the preferred embodiment, one out of eight weighted payouts from table 294. Any value could be used for the number of weighted payouts and in the example J=8. An example of a weighted payout table is set forth in the following table for the dollar gaming machines G of the ongoing example:

TABLE I

| PAY | WEIGHT |
|---|---|
| $5 | 50.40% |
| $10 | 25.00% |
| $25 | 12.50% |
| $50 | 6.25% |
| $75 | 3.12% |
| $100 | 1.56% |
| $250 | 0.78% |
| $1,000 | 0.39% |
| | Total: 100% |

The controller-based system 200 as discussed above with respect to FIG. 5 generates a signal 542 at times 610 and 620 (shown in FIG. 6) from the random player selector 270 to the jackpot winner selection process 290, as shown in FIG. 2. In the preferred embodiment, the random payout selector 292 continuously operates at a selection speed of 20,000/second so as to have weighted payouts continually available. While this speed is preferred, any suitable speed could be used. In response to signal 542, process 290 receives a weighted payout 296 from the random payout selector 292.

An example of a weighted payout table appears in Table I above. The value of the payout in Table I can be any suitable range of values. Each payout is given a "weight." The "weight" is the frequency that the payout is given. Hence, the five-dollar payout is given 50.4 percent of the time, the ten-dollar payout is given 25 percent of the time. The jackpot of $1,000 is given is given out 0.39 percent of the time. Again, the weights can be any suitable percentage or range of percentages as long as they total 100%. The design of the payout amounts (pay 1 through pay J) and the weights (i.e., weight 1 through weight J) are designed for the jackpot game of the present invention and are based upon the contribution collected 240 so as to make the game fair to the player yet profitable to the operator of the game. Based upon the weighted percentage payouts, as illustrated in Table I above, the most frequent payouts are: five dollars, ten dollars, twenty-five dollars, and fifty dollars. Less frequent payouts are: seventy-five dollars, one hundred dollars, two hundred fifty dollars, and one thousand dollars.

When a bonus award (or payout) is made by the jackpot winner selection process 290, the bonus jackpot amount is delivered 298 to the "pay winner" function 254 which immediately credits over network 202*b* the amount in the credit register 390 (see FIG. 3*a*) of the identified winning eligible machine before the conventional game ends. The indicator 320 is activated so that the player is informed of the win and how much has been won while playing the conventional game. This adds further excitement to the player. Likewise, that amount 298 is used by the decrement current function 256 to decrement the current value (or jackpot pool) 220. This process, as previously discussed for FIG. 2, continues until the value in the current value (or jackpot pool) 220 equals or drops below zero to end 260 the bonus mode time period.

It is to be expressly understood that the weighted payout table shown in Table I is only an example. In operation, the controller 200 is fully programmable by the operator to provide hit frequencies and payout jackpots of any value.

Because the award of bonus jackpots are determined by the controller 200 of the present invention, the conventional game play, on either eligible or ineligible gaming machines, is wholly unaffected.

The following three games illustrate the operation of the weighted payout table 294 in conjunction with the operation of the decrement current function 256 on the current value (or jackpot pool) 220.

Game I illustrates a typical game having eleven bonus jackpot rounds during a single bonus mode time period. FIG. 6 only illustrates the first two bonus jackpots or rounds 610 and 620. The bonus mode time period starts 248 with the current value 220 equaling or exceeding 246 the bonus mode trigger 218 of $200. The current value or jackpot pool is set to the trigger value 218 of $200. If the current value 220 at the start 248 exceeds the trigger value 218, the excess is set aside as will be more fully explained later.

GAME I

| BONUS AWARD ROUND | PAYOUT VALUE 298 (DOLLARS) | CURRENT VALUE JACKPOT 220 (DOLLARS) | FUNCTION 258 |
|---|---|---|---|
| | | $200 | |
| 1 | 5 | 195 | |
| 2 | 50 | 145 | |
| 3 | 5 | 140 | |
| 4 | 5 | 135 | |
| 5 | 10 | 125 | |
| 6 | 25 | 100 | |
| 7 | 5 | 95 | |
| 8 | 5 | 90 | |
| 9 | 10 | 80 | |
| 10 | 5 | 75 | |
| 11 | 10 | 65 | |
| 12 | 5 | 60 | |
| 13 | 5 | 55 | |
| 14 | 50 | 5 | |
| 15 | 10 | −5 | 0 |

In Game I, and with reference to FIG. 6, if in jackpot round number 1 (corresponding to bonus jackpot 610 in FIG. 6), eligible player E9 wins five dollars. Eligible player E9 has his bonus winner indicator 320 activated and his credit register 390 (as shown in FIG. 3) automatically incremented 254 by the controller 200 of the present invention by five dollars. As this occurs, the decrement current function 256 in the controller 200 causes the value in the current value (jackpot pool) 220 to be decremented by five dollars or to $195. This process continues until the current value (jackpot pool) 220 is equal to or less than zero. Hence, in bonus award round 15 of Game I, the jackpot payout value 298 of ten dollars causes the current value (jackpot pool) 220 to become a negative five dollars and function 258 detects this and the controller causes the bonus mode time period to end 260. Game I of the present invention is now over.

As previously discussed, the current value 220 now has a value of a negative five dollars which is used for the initial current value for the next game cycle of the present invention.

The controller 200 of the present invention randomly picks a new bonus mode activation trigger 218, which for Game II is one hundred fifty dollars. The controller 200 collects contributions 240 to increment 244 the current value 220 until the current value 220 equals or exceeds 246 the bonus mode activation trigger 218 to start 248 a new bonus mode time period. The current value (jackpot pool) 220 is set to the trigger value 218 of one hundred fifty dollars and any excess in the current value 220 is set aside. Game II is illustrated below:

GAME II

| BONUS AWARD ROUND | PAYOUT VALUE 298 (DOLLARS) | CURRENT VALUE JACKPOT 220 (DOLLARS) | FUNCTION 258 |
|---|---|---|---|
| | | 150 | |
| 1 | 5 | 145 | |
| 2 | 5 | 140 | |
| 3 | 25 | 115 | |
| 4 | 5 | 110 | |
| 5 | 10 | 100 | |
| 6 | 10 | 90 | |
| 7 | 100 | −10 | 0 |

The bonus mode time period for Game II starts with the first bonus award round paying five dollars to the surprised player who is randomly selected. The current value register 220 is reduced by five dollars from one hundred fifty dollars to one hundred forty five dollars. This process continues until round 7 where the eligible gaming machine randomly selected for the payout of one hundred dollars suddenly causes the current value 220 to be reduced from ninety dollars to minus ten dollars which causes it to drop below zero. The bonus mode time period for Game II of the present invention is now ended 260. For each jackpot payout, a different machine G is randomly selected by process 270 in controller 200. It is possible that the same machine may be randomly selected more than once in a game.

For Game III the system 200 of the present invention uses the current value 220 of minus ten dollars for Game II as the initial current value 220 for Game III plus the base value, which in this example is set to zero. Hence, in Game II, the contributions are collected 240 to increase 244 the current value 220 from minus ten dollars to the newly randomly selected trigger value 218, which is illustrated in Game III below to be one hundred seventy five dollars.

GAME III

| BONUS AWARD ROUND | PAYOUT VALUE 298 (DOLLARS) | CURRENT VALUE JACKPOT 220 (DOLLARS) | FUNCTION 258 |
|---|---|---|---|
| | | 175 | |
| 1 | 1000 | −825 | 0 |

In Game III, one thousand dollars is hit on the first round to a randomly selected eligible gaming machine. This immediately causes the initial current value 220 to drop to minus eight hundred twenty five dollars which is well below zero. The bonus mode for Game III ends 260 in the first bonus award round.

For the next game the current value 220 from Game III of minus eight hundred twenty five dollars is used and the process of collecting contributions 240 incrementing 244 until the current value 220 equals the bonus mode value 218 occurs. This will take a period of time to accomplish.

The preferred embodiment of the present invention always fully pays the "negative" value that the jackpot pool has before the next bonus mode is started 248. The fact that the "negative value" is different from game to game of the present invention and becomes the current value for use in eventually triggering the next bonus mode start 248 adds to the randomness and unpredictability of the present invention. It is to be understood that from time to time a "negative value" is not obtained since it is possible the current value at the end of a bonus time equals zero.

In the random payout selection process 292, it is apparent from the above, that the controller 200 of the present invention randomly selects a weighted payout from a weighted payout table 294 for each bonus jackpot. The use of a weighted payout table 294 is preferred, but optional under the teachings of the present invention. Any payout schedule based on the use of a random number generator in the controller could be utilized under the teachings of the present invention. Furthermore, providing a fixed value such as $10 for each bonus jackpot or a sequence of fixed values such as $50, $25, $10, $5, $1, $0.50, $0.25, etc., in lieu of a table could also be used.

7. Operating Environments.

In FIGS. 7 and 9 the progressive gaming system 200 of the present invention is set forth in a first operating environment embodiment. In this embodiment, the gaming machines G are oriented around a circular frame 700. Audio and digital displays 710 are placed in a region on the frame 700 near the gaming machines G. A sound and light show can be generated from the center 720 of the circular frame 700, which can include audio, visual, mechanical effects or a combination thereof. In FIG. 9, a computer 900 is shown which interconnects with an audio system 910 and a visual display 920. The audio display 910 with reference back to FIG. 7 can comprise of a sound system located anywhere on the frame 700 or nearby. The visual display 920 can also be located in a pattern of digital displays, lights, etc. on or around the frame 700. The precise nature of the displays 910 and 920 is not important to the teachings of the present invention as those can be programmed into formats stored in memory 930. The object of the overhead signage, lights, sound, and graphics 910 and 920 is to provide the following display modes:

TABLE II

| MODE | START 248 | PAY WINNER 254 | END 260 |
|---|---|---|---|
| ATTRACT | OFF | OFF | ON |
| BONUS | ON | OFF | OFF |
| JACKPOT | ON | ON | OFF |

The "ΔATTRACT" mode set forth in Table II above is used to attract and advertise the game of FIG. 7 to prospective players. For example, an attract format stored in memory 930 might have an audio voice announce:

"Any coin might trigger the money!"

At the same time, the format 930 may have an overhead display 920 display "MONEYTIME". Additional graphics in display 920 could explain the rules of the game of the present invention.

During the "bonus" mode set forth in Table II above, the controller 200 has issued the start 248 signal, which indicates the start of the bonus mode time period. During the bonus mode time period, a second format can be selected from memory 930, which causes the audio 910 to announce "It's bonus time!" Music can be played which contributes to the excitement. In addition, the overhead meter 710, which forms part of the visual display 920, can be flashed with "dancing coins".

Finally, during the "jackpot" mode in Table II above, the start 248 has occurred and a pay winner 254 signal occurs indicating one of the eligible gaming machines has received a bonus award. During this mode the computer 900 selects a celebration format from memory 930 to drive audio system 910 and the visual display 920 celebrating with frenzy and fanfare that a player has won a bonus jackpot and stating the value of the jackpot.

Figure 8:
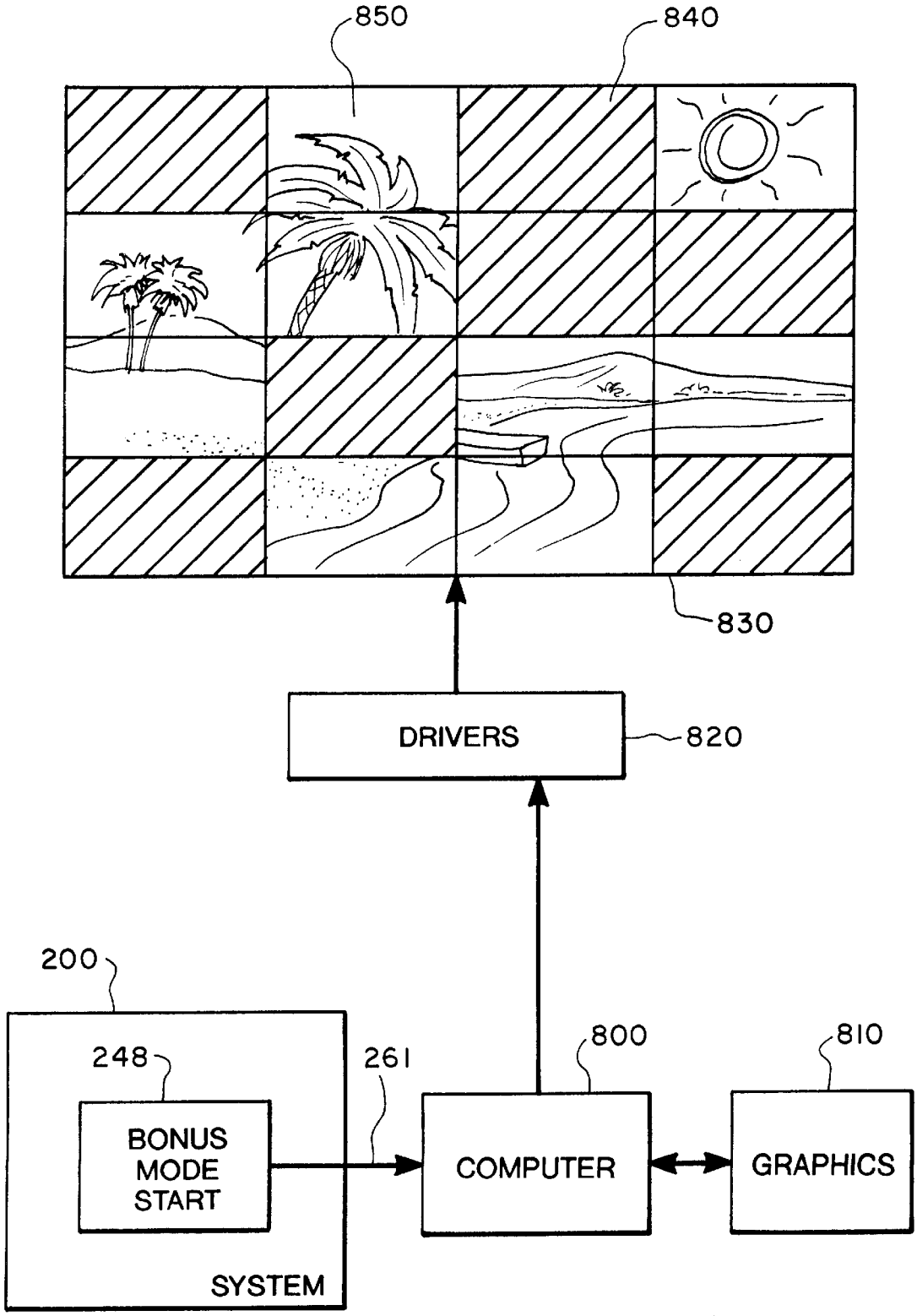
FIG. 8 sets forth an embodiment with the system of the present invention driving a jigsaw puzzle.

In FIG. 8 is set forth a second operating environment embodiment wherein the system 200 interfaces with a standard computer 800 having graphics memory 810 interconnected to a set of drivers 820 which in turn are interconnected with a display 830. The display 830 is large and can be positioned in the area around the controller 200 of the present invention such as near the island 230 of FIG. 2. It is to be expressly understood that the computer 800, graphics memory 810, driver 820 and display 830 are conventional. The computer 800 receives the start 261 signal from the bonus mode start 248, as previously discussed. When this signal 248 is detected, computer 800 operates as follows.

The display 830 is comprised of a plurality of segments 840. Each segment 840 could be in the shape of a square or rectangle as shown in FIG. 8 or in the shape of a standard jigsaw puzzle configuration. Each time the computer 800 receives signal 261 a new segment 840, on a random basis, is turned over to reveal a portion of a picture 850. If an eligible player is able to discern what the entire picture 850 is, then the player is entitled to yet another prize. This adds further excitement and attraction to the game.

It is to be expressly understood that the controller 200 and the computer systems shown in FIGS. 8 through 9 may all be implemented in the same computer controlled system 200. The embodiments shown in FIGS. 8 and 9 are illustrated using separate computers, which are specifically designed to handle large digital graphic and sound displays.

Figure 10:
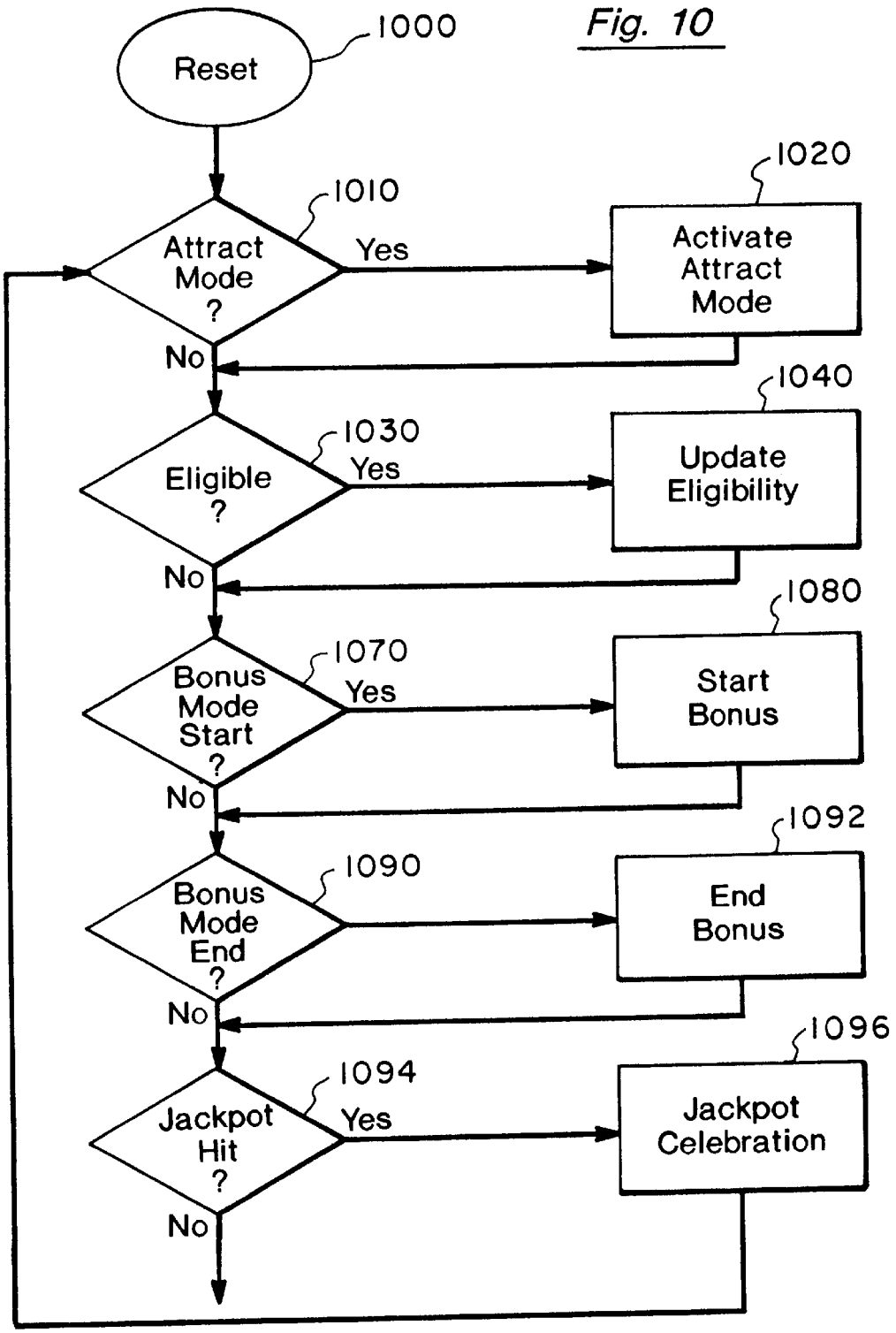
FIG. 10 sets forth a flow chart for the overall operation of the system of the present invention.

The overall operation of the controller-based linked random jackpot controller 200 of the present invention as shown in FIG. 2 is presented in FIG. 10. In FIG. 10, the system is initially reset in stage 1000. In stage 1010 the system ascertains whether it is still in the attract mode and whether the bonus mode is active. If the system is not in the bonus mode, then the process enters stage 1020 to activate the multimedia display in FIGS. 7 and 9 so as to attract players at the carousel 700 in FIG. 7. Stage 1030 is then entered wherein the system checks each gaming machine G to ascertain whether any eligibility status (see FIG. 4) has changed for any given machine. If the answer is yes, stage 1040 is entered wherein all eligible indicators 300 (FIG. 3) are updated as to eligibility. New gaming machines G that have become eligible have their eligibility indicator 300 activated in stage 1040 and gaming machines which lost eligibility have their indicators de-activated to indicate that they are no longer eligible. This was shown in FIG. 3 and fully discussed with respect to FIG. 4.

Stage 1070 is then entered. Stage 1070 inquires as to whether the bonus mode start 248 has occurred. If so, stage 1080 is entered and the system as shown in FIG. 9 over lines 248 starts the multimedia system through use of computer 900. This announces to all players that the bonus mode time period has started and the celebration commences. The bonus mode indicator 310 at each machine G is activated and the eligibility indicators 300 are locked on to be continually activated throughout the bonus mode time period. Stage 1090 is then entered to determine whether the bonus mode is over at stage 260 in FIG. 2. If the answer is yes, then stage 1092 is entered and the celebration is stopped by sending a signal 260 to the computer 900 as shown in FIG. 9 to stop the celebration. The bonus mode indicator 310 at each machine is de-activated and the eligibility indicators 300 are unlocked. Stage 1094 is then entered to ascertain whether or not a jackpot is hit. If it is hit, then the computer 900 is instructed over lines 254 to provide a jackpot celebration in stage 1096. In addition, the bonus winner indicator 320 at the winning machine is activated. This process then repeats at 1010.

Figure 11:
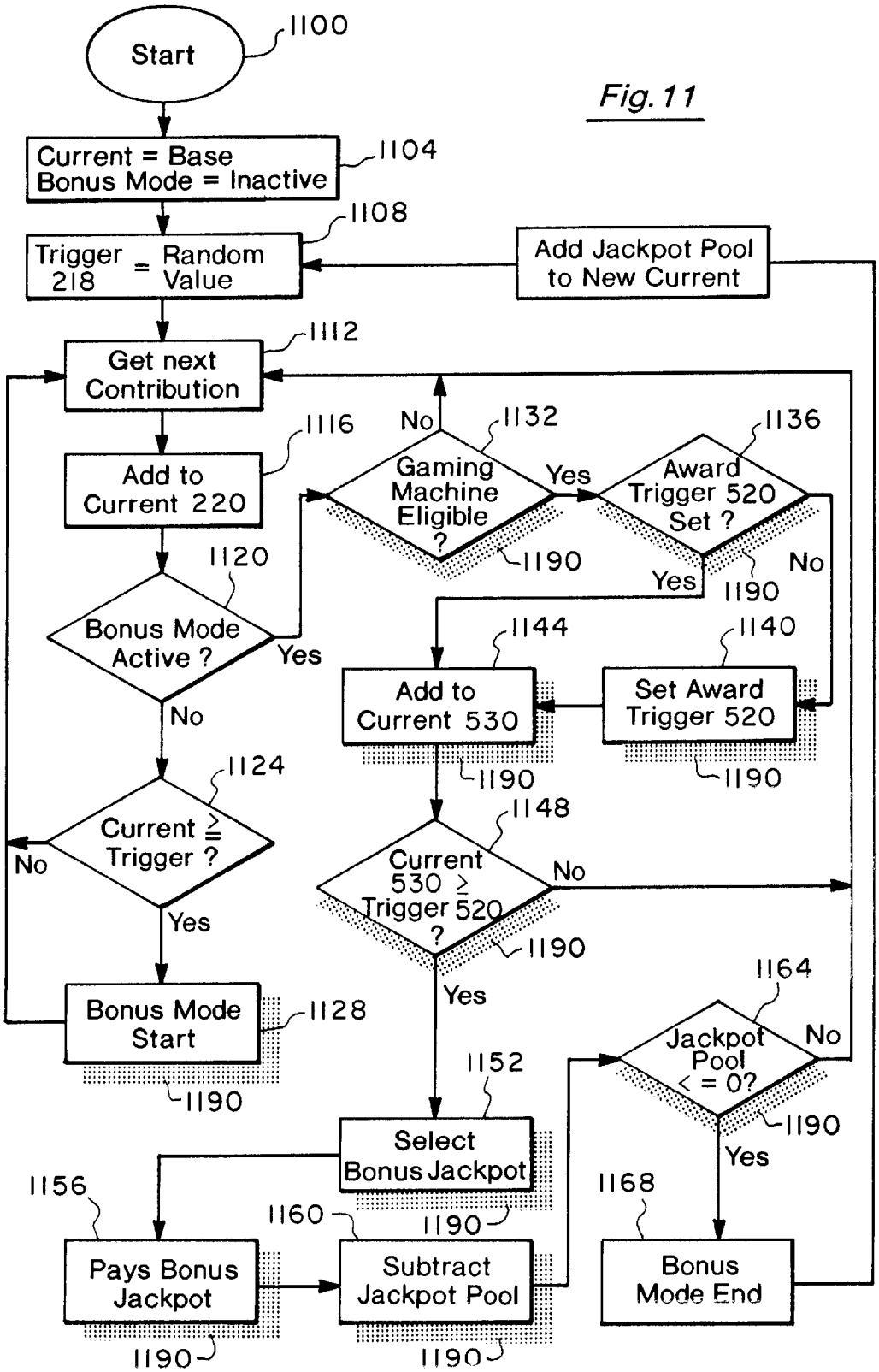
FIG. 11 sets forth the flow chart for entering the bonus mode and awarding bonus jackpots.

The flow chart for the functions discussed in FIG. 2 is set forth in FIG. 11. The controller 200 initializes and starts 1100 and then enters stage 1104 where the current value 220 is set equal to the base value 216 which in the preferred embodiment is zero. In addition, the bonus mode 248 is set to the inactive state. The system then enters stage 1108 wherein the bonus mode trigger 218 is set equal to a random value between the high limit 212 and the low limit 214. It is well known in the art how to pick random integers between the high limit 212 and the low limit 214. The random number generator (RNG) for this is in the controller 200. Polling stage 1112 is then entered which obtains the next contribution 242 via function 240 from the gaming machine being polled 255 where a monetary amount is entered (such as a percentage of the coins played such as is done in the '909 patent). In stage 1116, this contribution 240 is added to the current value 220. Stage 1120 is entered to ascertain whether the bonus mode is already active. If the bonus mode is not active, then stage 1124 is entered and a determination is made whether the current value 220 is greater than or equal to the bonus mode trigger 218. If not, stage 1112 is re-entered and the process continues to receive contributions 240 from each polled 255 gaming machine G for monetary values entered by players P until in stage 1124 the answer is yes.

In FIG. 11, the shaded operational areas 1190 indicate that the bonus mode is activated (i.e., bonus mode has started 248). The controller 200 then enters stage 1128. Here the bonus mode is started 248 and the controller 200 sets the bonus mode into the active state, the bonus jackpot pool is set equal to the value of the bonus mode trigger 218, the bonus mode timer ΔD 264 is started and the next current value 220 is set equal to the base value 216 (which is zero in the preferred embodiment) plus (the current value 220 minus the bonus mode trigger value 218). The value in parenthesis represents the excess discussed earlier, which corresponds to the contribution over the trigger value 218. For example, the current value 220 may exceed the trigger value 218 by $2 when the bonus mode is started 248, so the next current value 220 equals $2. The process then returns to stage 1112 wherein new contributions made during the current bonus mode time period are added 1116 to the next current value 220. Stage 1120 is then entered and since the bonus mode is active, stage 1132 is now entered. In stage 1132, a determination is made whether a particular gaming machine G being polled is eligible. If the gaming machine is not eligible, then stage 1112 is re-entered to poll for next machine. It is to be expressly understood that the controller polls 255 each machine G. If the gaming machine being polled is eligible, then stage 1136 is entered. In stage 1136, a determination is made as to whether the award trigger 520 has been made. If the answer is no, then stage 1140 is entered wherein (and as shown and discussed with respect to FIG. 5), the random value of the award trigger 520 is set between the high limit 500 and the low limit 510 by the controller 200 as shown in FIG. 5. At the same time the value of the current 530 is set equal to 0. Stage 1144 is then entered wherein any unit bets for that gaming machine G are counted and added to the current value 530 (as illustrated and discussed with respect to FIG. 6). It is to be understood that if in stage 1136, the next award trigger 520 had already been set then stage 1144 would have been directly entered.

Stage 1148 is entered to determine whether or not the current value 530 equals or exceeds the award trigger value 520. If the answer is no, then stage 1112 is entered for the next gaming machine in the polling process. The next gaming machine is then interrogated in the above-described fashion. However, if the current value 530 equals or exceeds the award trigger 520, then stage 1152 is entered. In stage 1152, the random payout selector 292 selects a bonus jackpot from the weighted pay table 294 and in stage 1156 pays 254 the gaming machine that receives the jackpot. This was fully discussed with respect to FIGS. 2 and 3 wherein the I/O board 370 activates indictor 320 and causes the conventional credit meter 390 in the gaming machine to credit the amount. In addition, the tower lamp 380 may or may not be activated. In the preferred embodiment, all of this occurs before the conventional game at that gaming machine is over. It is to be understood that the jackpot could be awarded 254 at any time. Stage 1160 is now entered. In stage 1160, the value of the bonus jackpot awarded to that winning gaming machine G is subtracted from the jackpot pool.

Then stage 1164 is entered. In stage 1164, a determination 258 is made whether the current value jackpot pool) 220 is less than or equal to zero. If it isn't, then the polling process repeats in stage 1112 for the next gaming machine. If the value of the jackpot pool is less than or equal to zero 258, then stage 1168 is entered and the bonus mode is sent to the inactive state (bonus mode end 260).

The current value 220 for the next game of the present invention is set in stage 1172 to the value of the jackpot pool, which as explained could be, and usually is negative. The following example based upon Games I and II above, is used to illustrate the operation of stage 1172. In Game I, the current value 220 incremented 244 until it exceeded the trigger value 218 of $200. When this occurred the current value equaled $202 so the excess of $2 was set aside for the next current value (for Game II) and the current value 220 (for Game I) became the jackpot pool. During the bonus mode time period of Game I, the controller 200 continued to collect contributions in stage 1112 and adds these contributions to the "excess" in the next current value 220 (for Game II). When Game I ends 258, the current value 220 (for Game I) is negative $5. In stage 1172, the controller adds the current value 220 at the end of Game I to the next current value 220 (for Game II) which at the end of Game I includes the value of the "excess" and the value of all contributions 1112 and 1116 added to it during the bonus mode time period for Game I. A base value, as used in the '909 patent could also be added to new pool (Game II) as an option.

It can be appreciated that the next current value 220 for the next game of the present invention is truly random and unpredictable.

8. Bonus Game Having Secret Bonus Pool.

Figure 12:
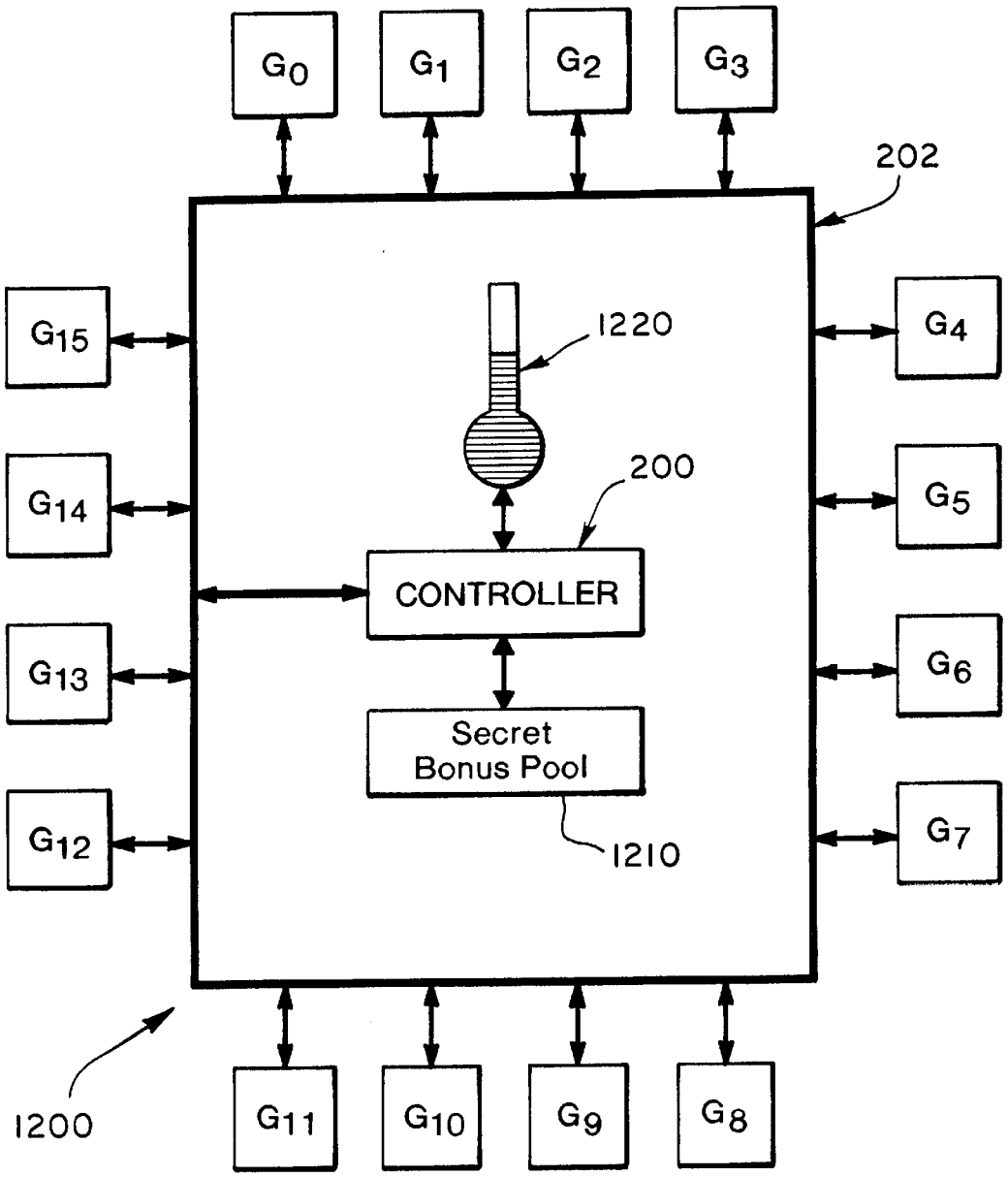
FIG. 12 is a system block diagram of the bonus game of the present invention.

In FIG. 12 is shown the secret bonus pool system 1200 in an alternate embodiment to the present invention which includes a plurality of games G and the controller 200. The controller 200 interconnects to bus 202, which in turn interconnects to the games G. In the alternative embodiment sixteen games ($G_0$–$G_{15}$) are shown and it is to be expressly understood that any number of games G could be interconnected to bus 202. Games G can be any conventional game which a player plays according to game rules established for that conventional game as previously discussed. In this alternative embodiment, a bonus game is provided, displayed and played at each eligible gaming machine. The bonus game has different game rules than the conventional game played at the gaming machine. The bonus game discussed in the following is an m×n array (or matrix) of doors 1310 on a display 1300 at each gaming machine G.

Figure 13:
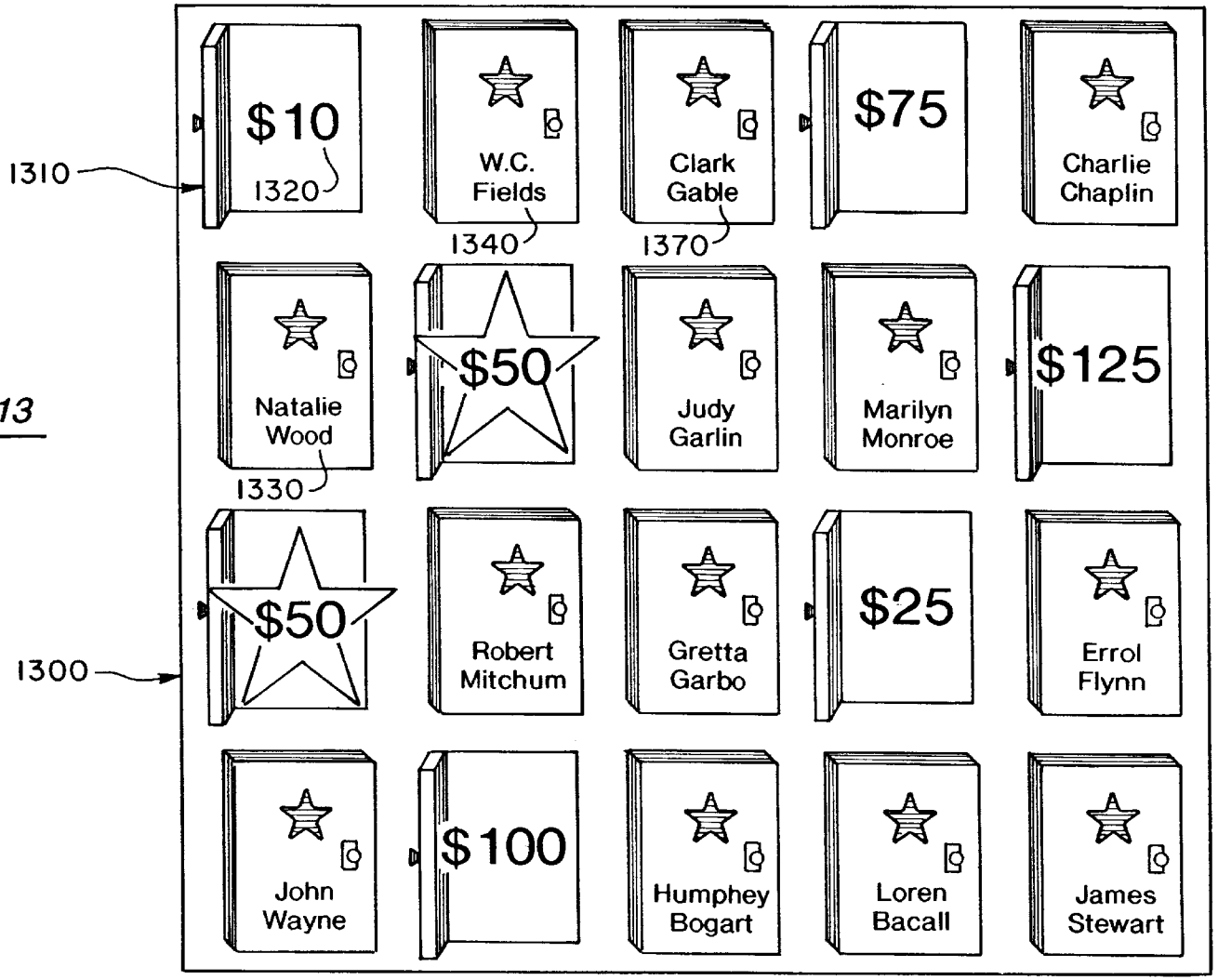
FIG. 13 sets forth an illustration of playing the bonus game of FIG. 12.

A secret bonus pool 1210 builds in anticipation of a system 1200 wide bonus mode feature. At some unknown time, the system 1200 finally explodes into a frenzy bonus mode 248 as previously discussed. Once in bonus mode, and as shown in FIG. 13, as each eligible player wagers credits on their gaming machine G, a prize door 1310 is opened on the player's bonus LCD display 1300. A cash amount 1320 is revealed behind each door 1310 when turned over. When the player opens two prize doors 1310 each having the same cash award, that cash award is given to the player through automatic credit pay.

The system 1200 creates a heightened and accelerating frenzy effect as players at games G reveal many types of distinct cash awards that only they have received. The LCD display 1300 may contain many different prize doors that have been revealed . . . cash prizes 1320 like $25, $15, $50, $5, $75, $250, . . . ! The player has the following thought in anticipation of receiving a bonus award, "In only one more game one of those doors is gonna open, and it's only a matter of time that something is gonna match!" The total number of distinct prizes 1320 are chosen so as to maximize player expectation, and to create more winning combination possibilities. This fuels the need for more play during bonus mode in order to "grab" personal prizes granted to each player during bonus mode. As more doors 210 are open, the chance of hitting any prize increases . . . this means that the bonus mode will start slowly, and continue to accelerate towards a rapid bonus giveaway; in effect, the players are racing towards the cash!

As each award is paid to players who match prizes, the value of the award is subtracted from the secret bonus pool 1210. Once the bonus pool 1210 reaches zero (or any predetermined value), the system exits 260 the bonus mode as priorly taught. As an option, a temperature gauge 1220 (or other suitable display) can be supported by the system 10 to indicate to all players the remaining amount of time in the bonus mode. This gauge 1220 actually represents the remaining amount of currency in the bonus pool which is no longer secret.

Also included in the bonus award giveaway is a "trump award", null, or zero value award. This award is typically the most frequent occurrence, and is used to maximize and adjust bonus mode length and average number of games played in bonus mode.

a. Theme

Figure 14A:
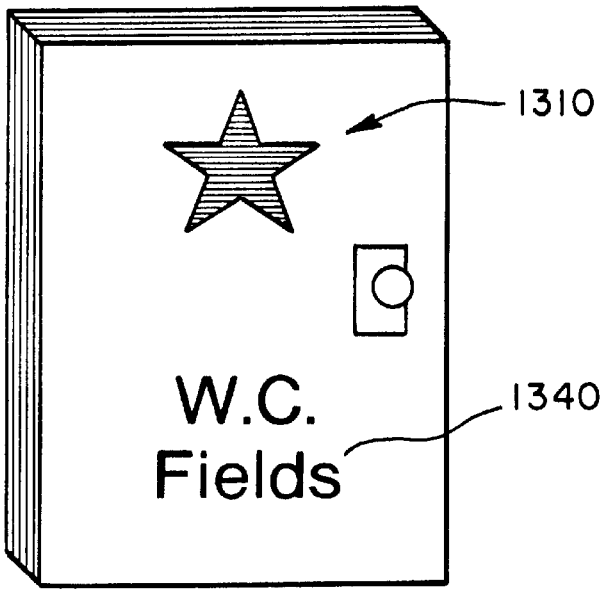
FIGS. 14*a* and 14*b* illustrate opening a single door to show the image of a person.
Figure 14B:
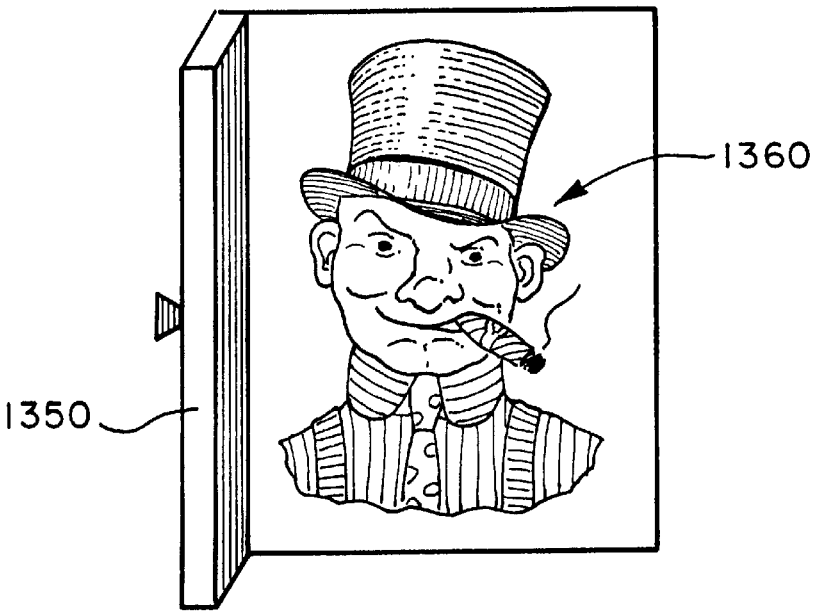

One possible theme for this system embodiment 1200 of m×n doors 1310 is that of "Hollywood Stars." At the beginning 248 of the bonus mode, the LCD 1300 shows all of the doors 1310 of all the stars 1330. Each door 1310 is actually the entry into the star's dressing room and has the star's name 1330 printed on the door. If the door opens, and there is no cash value, a picture 1360 of the star tells you in a phrase they have made famous. For example, and as shown in FIG. 14(*a*), one door 1410 is labeled "W. C. Fields" 1440; when his door is opened 1450, and no cash value is awarded, a sound card 1500 (FIG. 15) in the machine G announces: "There's a sucker born every minute!". An animation 1360 of W. C. Fields 1340 can be supported on the LCD panel 1300, and once over, the door 1310 slams shut. Another door 1310 might be labeled "Clark Gable" 1370, and if his door is opened without an award, his character announces: "Frankly my dear, I don't give a damn!".

If a cash award 1320 is revealed behind the door, then the sound card 1500 would use a producer's voice to say "your gonna be a star kid . . . here's 50 bucks!" In this case, the door 1310 stays open, and remains open until another $50 dollar cash award is revealed, or until the bonus round is over 260. At the end of the bonus round 260, a cartoon voice with animations appears in the LCD 1300 and replaces the doors that announces: "That's all f-f-f-folks!" The bonus carousel 720 itself is adorned with Hollywood effects, including huge spotlights, three-dimensional star-like statues, and pictures of commonly recognized Hollywood themes and personalities. The system will support up to any number such as 20 different stars.

It is to be expressly understood that any "theme" could be used under the teachings of this alternate embodiment. For example, the doors could be (a) coins that are flipped to show a value (or no value), (b) jack-in-the-boxes that spring open to award prizes, or (c) any of the conventional state lottery "scratch" themes. Furthermore, while a combination of two matches is used to make an award, any matching combination (such as three, four, or more) could be used.

Figure 15:
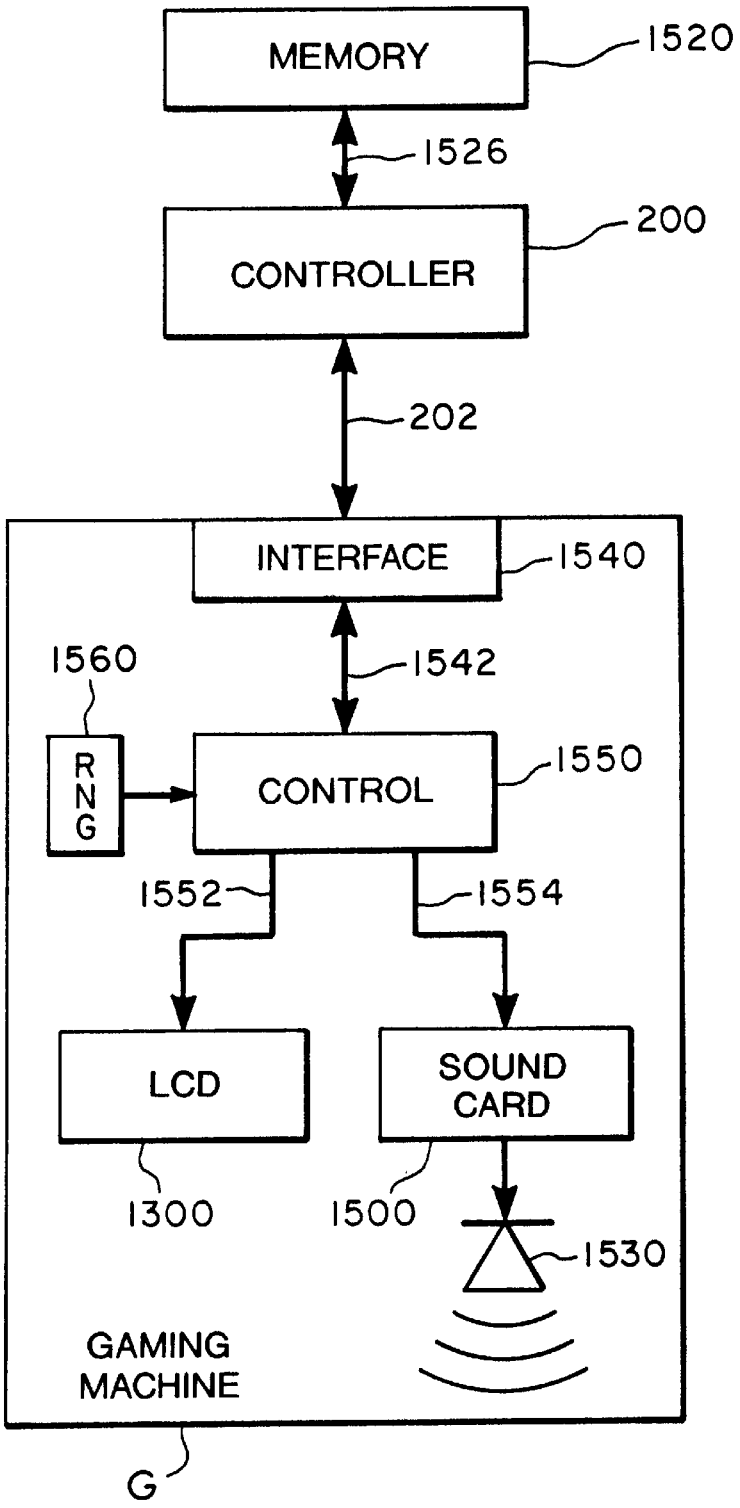
FIG. 15 is a block diagram of the bonus game of the present invention as shown in FIG. 12.

In FIG. 15, the controller 200 is shown connected over bus 202 to an interface 1540 at a game G, the interface is connected to a control 1550 over lines 1542. The control 1550 is connected to the display 1300 over lines 1552, a sound card 1500 over lines 1554, the controller 200 is connected to memory 1520 over lines 1520. In gaming machine memory 1520 are stored all of the necessary data for the various graphical displays (e.g., door 1310, cash values 1320, animations 1510, etc.) and for the sound cards 300 (e.g., the phrases) for executing the "theme" of the bonus game in the gaming machine G. The control 1550 is a conventional microprocessor which may be connected to a random number generator 1560 or which may have a software random number generator routine. The sound card 1500 drives a stereo sound system 1530.

As an option to this embodiment, a special "final" bonus prize mode can be supported. Once the bonus mode is over, each door will automatically open in fast sequence to reveal pieces of a personal "hidden puzzle". If two of the doors has a matching mystery prize symbol, the hidden picture will reveal the player's bonus prize; this prize will be the largest award possible, and could be a progressive, a car, or a trip to Hollywood! If the doors reveal a "flop", a B rated movie, or a 'cut', then no final bonus prize is awarded. The special mystery symbols can also be handed out during bonus mode as one of the prizes, and then the player must only catch one more behind one of the closed doors after bonus mode ends.

When not in bonus mode, the display 1300 and sound card 1500 will default to one of many auto-attract sequences. These attract sequences will be selected both randomly but also influences the current rate of play system wide.

b. System Operation

In most respects, this alternate embodiment of having a bonus game operates similarly to the embodiment shown in FIGS. 1–11. Player eligibility is the same. Financing the bonus pool, triggering the bonus mode, and turning on and off the bonus mode are the same. A color LCD panel 200 is mounted at or near each game G for purpose of game display for each player. This could also be a CRT, LED display or any equivalent visual display device. A stereo sound system 1530 is mounted at or near each game G. The system 1200 requires existing credit pay protocol support such as found in the SP766IGT game or the BALLY mystery pay protocol feed now supported in all new commercially available BALLY games.

In this system 1200, the controller 200 will poll each gaming machine G over bus 202 to obtain game start and wager information. If during the poll, the controller detects wager information and a valid game start, the LCD display 1300 will then be programmed to "reveal a door" at that gaming machine. The controller 200 randomly selects an award value from the table of weighted awards 294 as priorly discussed but, in contrast to the present invention, does so based upon each game start signal in each eligible gaming machine. This award value is temporarily recorded in a controller memory area 1520 specifically reserved for that machine G. If the award value has been previously recorded, then the award is paid to the credit meter of that machine since a "match" occurs. In the match case, the matching award is completely deleted from the controller memory 1520 of all current awards for that machine. When bonus mode exits, all tables in the memory are cleared of all jackpot values since all "prize doors" are reset for the start of the next bonus mode.

The player LCD display 1300 operates in conjunction with the process of storing and matching randomly selected awards within the controller 200 for each specific machine G. In other words, the in-machine display control 1550 has to track what the display 1300 should look like for that particular game. If the bonus game has three different prize doors open, then this corresponds to the fact that the controller 200 has recorded three prizes stored in it's memory 1520 for that machine. This information is broadcast to each display control 1550 at all times during bonus mode. The display 1300 for each machine G will look different, even though each player is competing for all available cash reserves in the secret bonus pool 1210. The in-machine display control 1550 operates the in-machine sound card 1500. This sound card 1500 is equipped with all possible star voices, the producer's voice, and any other effects and music needed for the Hollywood theme or for any other desired theme. The actual selection of stars and voices will occur on a random basis and will be controlled by the in-machine display control 350. The controller 200 is responsible for maintaining and distributing awards.

The overhead signage 710 must be equipped with a display celebration queue, since prizes may be awarded at the same time. In fact, it is typical that most prizes are awarded near the end 260 of the bonus mode, with many occurring at the same time. In other words, the display 710 will rotate through all awarded prizes in sequence of their occurrence. Some delay may be incurred in the event of multiple awards. Overhead signage 710 will be most typically aimed at celebrating all action to outside bystanders.

To summarize, the LCD display 1300 is organized in an M by N prize door 1310 matrix, where the controller 200 controls all previously issued prize door values. The in-machine display control 1550 will control the themed effect. When not in bonus mode, the player's LCD display 1300 is used to verify eligibility and to promote game play through attract mode celebrations.

c. Game Expectations

The pay table values, the contribution rate and the total number of awards are determined precisely. Also, the total number of prize doors 1310 must exceed the total number of specific prize values 1320 by one or more.

Given the award table below, assume that a player receives one of the awards from the table each time they play. Note the $0 award will typically have the highest value frequency.

TABLE II

| Payout Prize Value | Door 1310 Value Selection (or Hit) Frequency |
|---|---|
| $0 | 50% |
| $5 | 25% |
| $10 | 12% |
| $25 | 7% |
| $50 | 3% |
| $100 | 2% |
| $250 | .9% |
| $1000 | .1% |

The hit frequency of receiving any one prize door value is controlled by the payout hit frequency above. However, the chance of actually winning that prize is not the listed hit frequency. The reason for this is that two identical prizes must be granted before that prize is actually awarded.

In simulation, and given that one player is playing with an award pool of $10 and $100 respectively, the actual hit frequency for each award is as follows:

TABLE III

| Payout Prize Value | Payable Hit Frequency | Actual Hit Frequency for Pool of $10 | Actual Hit Frequency for Pool of $100 |
|---|---|---|---|
| $0 | 50% | N/A | N/A |
| $5 | 25% | 60.5% | 54% |
| $10 | 12% | 25% | 24.6% |
| $25 | 7% | 10.5% | 13.6% |
| $50 | 3% | 2.45% | 4.5% |
| $100 | 2% | 1.13% | 2.5% |
| $250 | .9% | .27% | .6% |
| $1000 | .1% | .002% | .006% |

For large pool values, where the number of game plays is high, the actual hit frequency approximates the paytable hit frequency. However, note that for low pool values, the frequency for hitting the high prize frequencies is higher, while that of the low prize frequencies is even lower. This means that the chance of the display 1300 showing a high value prize is much greater than the chance of actually hitting. Thus, $100 and $250 dollar prizes are likely to be displayed on some player's screen 1300, but their chance of receiving that value is much smaller.

Figure 16:
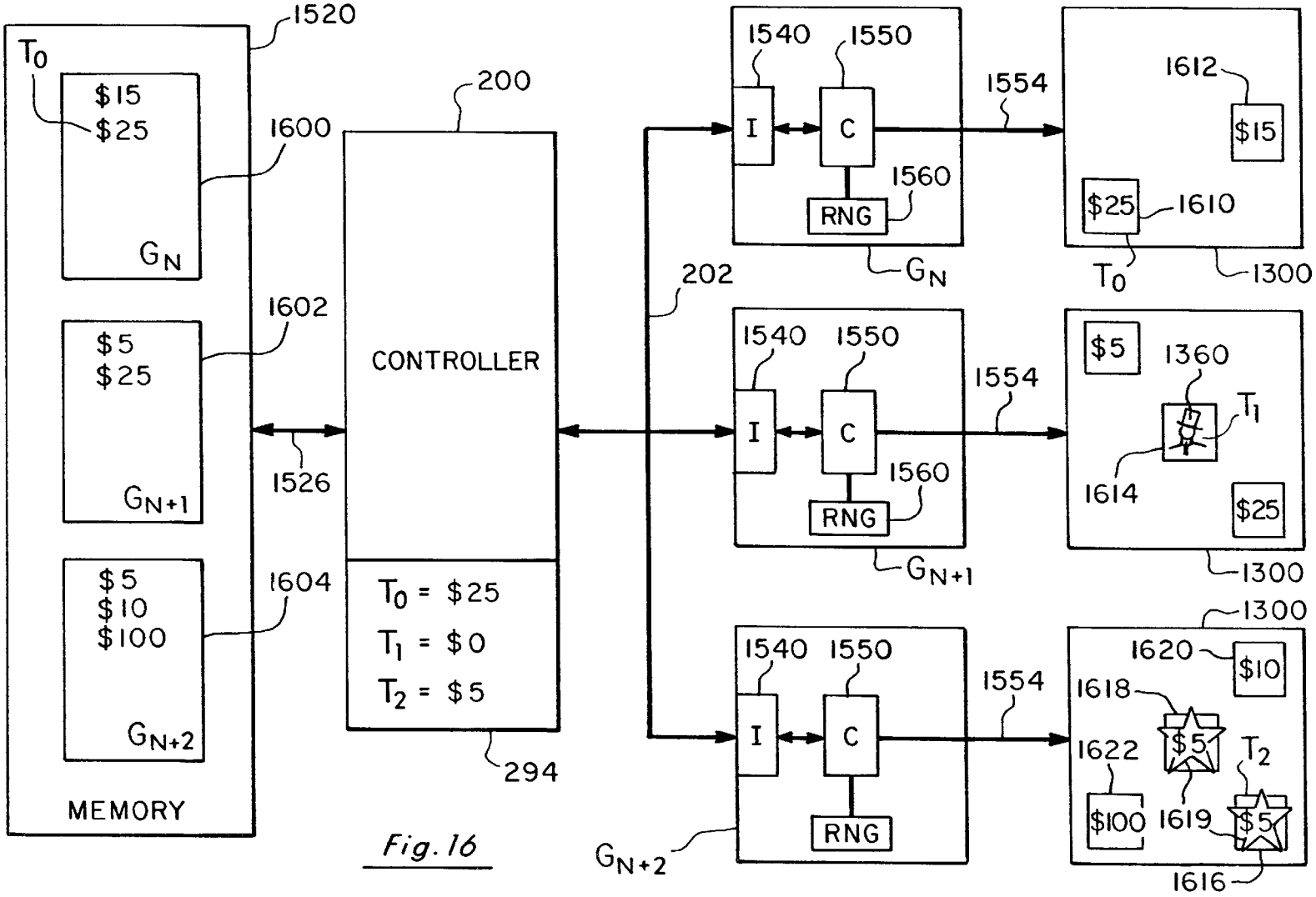
FIG. 16 is a system block diagram of the bonus game shown in FIG. 15.

In FIG. 16 is shown an illustration of the operation of the bonus game having the secret bonus pool feature of this embodiment. The controller 200 is interconnected with memory 1520 over local bus 1526. In memory 1520 is an area for each gaming machine G. Illustrated in FIG. 16 are three such memory areas 1600, 1602, and 1604 for gaming machines $G_N$, $G_{N+1}$, and $G_{N+2}$. The controller 200 is also shown in FIG. 16 interconnected over bus 202 to the three gaming machines $G_N$, $G_{N+1}$, and $G_{N+2}$. Each gaming machine G has its display 1300. Each display 1300 is interconnected over lines 1554 to the gaming machine control 1550.

In the illustration of FIG. 16, a player at time $T_0$ plays game $G_N$, a player at time $T_1$ plays game $G_{N+1}$ and a player at time $T_2$ plays a game $G_{N+2}$. The illustration operates during the bonus mode as follows.

At time $T_0$, controller 200 conventionally senses the start of the conventional game play in gaming machine $G_N$. Controller 200 receives from the weighted payout table 294 a jackpot bonus value of $25, which is indicated in FIG. 16 as corresponding to time $T_0$. The controller 200 accesses memory 1520 over lines 1526 for the memory table 1600 corresponding to game $G_N$. During a prior game played at gaming machine $G_N$ during the bonus mode, the controller 200 received a $15 jackpot bonus award from the payout table 294 and wrote it into memory location 1600. At time $T_0$, the controller 200 searches area 1600 to see whether the value of $25 had already been written for gaming machine $G_N$. The value of $25 had not priorly been written and the controller writes the value of $25 corresponding to time $T_0$. The controller 200 accesses the gaming machine $G_N$ over bus 202 through interface 1540 and delivers into control 1550 the $25 value. Controller 1550 randomly selects one of the remaining doors 1310 in display 1300 into which the $25 jackpot value is to be written. Door 1612 had earlier been opened with the value of $15 showing. In FIG. 16, the door 1610 is randomly chosen and opened. The $25 value is displayed corresponding to time $T_0$. The player at game $G_N$, after activating the start of the conventional game in gaming machine $G_N$, thereupon sees $25 displayed at door location 1610. Player has already witnessed the opening of door 1612 and the displaying of $15 in a prior game. The selection of which door 1310 to open is under control of the random number generator 1560 and the control 1550. This randomness provided to the bonus game having secret bonus pool is provided at the gaming machine G, but not limited to the game, since controller 200 may also determine location in another alternate embodiment. The player playing gaming machine $G_N$, in this illustration, does not win anything at time $T_0$.

At time $T_1$, the controller 200 in a conventional fashion determines that a player at gaming machine $G_{N+1}$ has started play of the conventional game contained therein. Controller 200 corresponding to time $T_1$ receives a zero dollar payout from the pay table 294 and delivers it to the control 1550 in game $G_{N+1}$. Controller 200 does not take the zero dollar payout (null value) and access memory 1520. The control 1550 at gaming $G_{N+1}$ receives a random number from the random number generator 1560 in order to select which of the remaining doors 1310 is to be opened. In the illustration of FIG. 16, door 1614 is opened which reveals a character 1360 and issues an audible "null" message through the sound card 1500 to the player. The player receives a null award which results in a character 1360 being illustrated and a phrase delivering a null message as discussed above. After the door 1614 opens and the phrase is stated, the control 1550 slams the door 1310 shut with a corresponding audible sound from sound card 1500. The door position at 1614 is made available to the control 1550 and the random number generator 1560 for the next selection. Hence, at time $T_1$, the player at gaming machine $G_{N+1}$ is informed that it won a zero or null award. Prior to and after time $T_1$, gaming machine $G_{N+1}$ continues to show in the display the bonus jackpots of $5 and $25, which are also stored in its corresponding memory location 1602 in memory 1520.

At time $T_2$, the controller 200 senses a player at gaming machine $G_{N+2}$ playing a conventional game in that gaming machine. Controller 200 receives a $5 bonus jackpot award corresponding to time $T_2$ from the weighted payout table 294. The controller 200 accesses memory 1520 over lines 1526 for the memory table 1604 corresponding to gaming machine $G_{N+2}$. It searches through the bonus jackpot awards already listed in that table of $5, $10, and $100. It sees a correspondence to the already stored $5 amount. The controller 200 knows that gaming machine $G_{N+2}$ has a win of $5 based upon the combination of two $5 awards. Since a win occurs, the $5 value in memory is erased leaving only $10 and $100. Controller 200 then sends the $5 amount plus a win indication over bus 202 to gaming machine $G_{N+2}$ through the interface 1540 and into the control 1550. Control 1550 for gaming machine $G_{N+2}$ knows that it is to display a win and to play a win audible announcement in sound card 1500. The player sitting at gaming machine $G_{N+2}$ sees the door open and the $5 jackpot bonus award displayed at position 1616. The priorly displayed $5 jackpot award shown at position 1618 is also displayed with a different background such as with a star 1619. The star 1619 could be flashing or grow in brilliance so as to inform the player immediately of the win. At the same time, the credit meter in the gaming machine $G_{N+2}$ is incremented by the amount of $5. In the preferred embodiment, this occurs before the conventional game being played by the player at gaming machine $G_{N+2}$ is finished. After the credit meter is incremented, the doors 1310 at positions 1616 and 1618 are closed leaving only the $10 and $100 doors open at positions 1620 and 1622. It is to be noted that the player at gaming machine $G_{N+2}$ had previously displayed $10 and $100 which is stored in memory location 1604 of memory 1520.

The illustration of FIG. 16 shows the operation of the bonus game having secret bonus pool of this embodiment during the bonus mode. At time $T_0$, the controller 200 and in response to game play at gaming machine $G_N$ inserts a $25 value in memory 1600 and causes it to be displayed in display 1300 at a random location 1610 as selected by control 1550 through interaction with the random number generator 1560. The player at gaming machine $G_N$ immediately sees the display of $25, which acts as encouragement to play machine GN as fast as the player can. At time $T_1$, the controller 200 in response to game play at gaming machine $G_{N+1}$ selects a null award which is not stored in memory area 1602 and which causes at a random location 1614 in display 1300 a "character" to be displayed and a null phrase to be played which most typically is humorously based. A null award of zero dollars occurs most frequently in the display of the character 1360 and the sound message sound card 1500 adds excitement to the play of the bonus game. Finally, at time $T_2$, controller 200 in response to game play at gaming machine $G_{N+2}$ receives a bonus jackpot value of $5 from the weighted payout table 294 which it matches in memory 1604 with a $5 value already stored. This matching combination causes the controller 200 to deliver a win signal to the controller 1550 in gaming machine $G_{N+2}$ so as to display the winning combination in doors 1616 and 1618 along with a win message from the sound card. The gaming machine $G_{N+2}$ receives the $5 credit in its credit meter.

It is to be expressly understood that the times $T_0$, $T_1$, and $T_2$ in FIG. 16 are for purposes of illustration. It is to be appreciated that with a number, such as forty gaming machines G, interconnected to a controller 200, that displays 1360 corresponding to a null award occurs most frequently throughout the forty machines. Furthermore, it is to be understood that a number of bonus values are displayed such as 1612 and 1622 on displays 1300 throughout the gaming machines G without a winning combination. Finally, when winning combinations 1619 are found by controller 200 in memory 1520, such winning combinations are visibly displayed 1619 along with a win audible message. The credit meters for those machines are then incremented by the amount of the bonus award. Null values are most frequent in the preferred embodiment but does not have to be. Null values are most important since their frequency can be used to adjust the rate of bonus awards.

It is to be appreciated that the illustration of FIG. 16 occurs during the bonus mode as previously taught. It is also to be appreciated, that more winning combinations 1619 occur towards the end of the bonus mode since it takes time to build up the displays such as 1610, 1612, and 1622. With more and more of these types of dollars being displayed in display 1300 across the various gaming machines, towards the end of the bonus mode, more winning combinations occur. As before, only one winning combination 1619 occurs in one gaming machine to cause the bonus mode to end 260. Furthermore, it is to be expressly understood that any winning combination could occur. For example, in the illustration of FIG. 16, two corresponding jackpot values cause a winning combination. The system could be designed to have three or more. Furthermore, the winning combination could be based upon a pattern such as three or four identical values in a row appearing in the display 1300. The control 1550 would detect the "in-row" combination and deliver a "win" signal back to the controller 200. It is to be expressly understood that the controller 200 could also determine such win combinations. In addition, a wild card feature could be utilized. For example, the weighted pay table 294 could issue a wild card symbol such as a four-leaf clover. The fact that a four-leaf clover was issued by the weighted payout table 294 would also be stored in memory 1520 and would be delivered to the control 1550 of the gaming machine causing the generation of the four-leaf clover. The four-leaf clover would then be displayed in one of the doors 1310 of the display 1300. When the next bonus value is displayed for that machine an automatic win would occur. These other variations to the teachings of the present invention could be implemented in the bonus game having a secret bonus pool of this embodiment.

The aforesaid method of operating the second or bonus game of the present invention in a linked gaming system having a plurality of gaming machines is summarized as follows. The second game for the linked gaming system becomes activated when the bonus pool equals or exceeds a certain high value. Each of the gaming machines is notified at the start of the bonus game of eligibility. The second game of the present invention has different game rules than the game rules for the gaming machines. As discussed, the gaming machines are conventional gaming machines and the second or bonus game is played at each machine in a separate display located at (i.e., on, in, or near) each gaming machine. In the preferred embodiment, the bonus game is a "door" game (i.e., a matrix of images such as doors) wherein a bonus jackpot value is randomly selected in response to game play occurring at any one of the gaming machines. In the preferred embodiment the bonus jackpot values are selected from a set of values including null values. The selected bonus jackpot values are then displayed at that gaming machine by opening the doors (i.e., replacing an image in the matrix with the value in an image of an open door). It is to be expressly understood that although "doors" are used, that any display image could be utilized such as stars, windows, dollars signs, etc. In other words, any image could be utilized. While the preferred embodiment causes the random selection of the bonus jackpot value and the display of it to occur in response to the start of conventional game play at the gaming machine, it is to be expressly understood that any suitable event occurring during the play of a game at a gaming machine could be utilized under the teachings of the present invention. Hence, selection and display could be triggered by coin-in, the start of game play, a predetermined time after start of play, at the end of game, or a period of time after the end of game play. The storing of the selected bonus jackpot value preferably occurs in the memory of the controller, but could be stored elsewhere such as in memory in the interface of the gaming machine. When the selected bonus jackpot value corresponds in value to one already stored, then a win occurs and the gaming machine is awarded the selected bonus jackpot value. The player knows that this has occurred because the player will see two bonus jackpot values displayed in open doors. The controller of the present invention at the same time can cause a light and sound promotion to also occur. The prior stored jackpot value is then erased in memory and the matrix images for the awarded bonus jackpot values in the display are restored. This step of erasing does not erase any other prior stored jackpot values, only the most recently selected bonus jackpot value. The steps of storing, awarding, and erasing may occur in a different order. What is important is that selected bonus jackpot value is displayed at a gaming machine so that the player can immediately see it in response to separate game play at the gaming machine. When bonus jackpot values are the same (i.e., a match) then an award is made. This is the preferred invention since one could easily have any combination, (e.g., three matching values, or a sequence of numbers such as one dollar, two dollars, or three dollars). Furthermore, rather than have dollars displayed, the number of coins to be awarded could be displayed such as three coins, ten coins, etc. In addition, rather than have dollars or coins displayed, symbols could be displayed corresponding to a monetary prize. The present invention is not to be limited by the nature of the image (i.e., the door) or of the displayed "selected bonus jackpot value."

The above disclosure sets forth a number of embodiments of the present invention. The present invention is not to be limited to a disclosure contained herein and other arrangements and embodiments, not precisely set forth, may be practiced under the teachings of the present invention and as set forth in the following claims.

I claim:

1. A method of operating a bonus game in a linked gaming system having a plurality of gaming machines, each of said plurality of gaming machines having a game based on machine game rules, said method comprising the steps of:

starting the bonus game in a display at each eligible gaming machine in the plurality of gaming machines when a bonus pool in the linked system is activated, the bonus game having bonus game rules different from the machine game rules for the gaming machines;

selecting a bonus jackpot value in response to game play at any one of the eligible gaming machines;

displaying the selected bonus jackpot value in the display of the aforesaid one eligible gaming machine according to the bonus game rules;

storing the selected bonus jackpot value when any prior stored bonus jackpot values for the aforesaid one eligible gaming machine are different than the selected bonus jackpot value;

awarding the selected bonus jackpot value to the aforesaid one eligible gaming machine when the selected bonus jackpot value equals a prior stored bonus jackpot value;

erasing the prior stored jackpot value equaling the selected bonus jackpot value;

subtracting the awarded bonus jackpot value from the bonus pool;

ending the bonus game when the bonus pool is brought to or below a predetermined value.

2. The method of claim 1 wherein the bonus game is a match game behind a plurality of displayed images, and said step of displaying further including the step of displaying the selected bonus jackpot value in place of one of the displayed images.

3. The method of claim 2 wherein the displayed images are closed doors formed in a matrix.

4. The method of claim 2 wherein which displayed image is replaced by the selected bonus value is randomly selected.

5. The method of claim 4 wherein the random selection occurs in the aforesaid one eligible gaming machine.

6. The method of claim 1 wherein the step of storing the selected bonus jackpot value occurs in a memory at a memory location for the aforesaid one eligible gaming machine and the step of erasing occurs at the aforesaid memory location.

7. A method of operating a second game in a linked gaming system having a plurality of gaming machines, each of said plurality of eligible gaming machines having a first game based on machine game rules, said method comprising the steps of:

displaying in a display at each eligible gaming machine in the plurality of gaming machines a matrix of images for the second game;

selecting a jackpot value for the second game in response to first game play at any one of the eligible gaming machines;

randomly selecting one of the images in the matrix of the display of the aforesaid one eligible gaming machine and displaying the selected jackpot value in its place in the display of the aforesaid one eligible gaming machine in response to the step of selecting;

storing the selected jackpot value when all prior stored jackpot values for the aforesaid one eligible gaming machine are different than the selected jackpot value in response to the step of selecting;

awarding the selected jackpot value to the aforesaid one eligible gaming machine when the selected jackpot value equals a prior stored jackpot value in response to the step of selecting;

erasing the prior stored jackpot value equaling the selected jackpot value in response to the step of awarding;

replacing the awarded selected bonus jackpot values displayed in the matrix with images in response to the step of awarding.

8. The method of claim 7 wherein the displayed images are closed doors.

9. The method of claim 8 wherein the random selection occurs in the aforesaid one eligible gaming machine.

10. The method of claim 7 wherein the step of storing the selected jackpot value occurs in a memory at a memory location for the aforesaid one gaming machine and the step of erasing occurs at the aforesaid memory location.

11. A method of operating a bonus game in a controller-based progressive jackpot linked gaming system having a controller and a plurality of gaming machines connected to the controller, said method comprising the steps of:

starting play of the bonus game in a display at each eligible gaming machine of the plurality of gaming machines when a bonus pool in the controller is activated, the bonus game having game rules different from the game rules for the gaming machines;

providing a plurality of bonus jackpot values;

selecting in the controller a bonus jackpot value from the plurality of bonus jackpot values in response to each bonus game played at any one of the eligible gaming machines;

displaying the selected bonus jackpot value in the display of the aforesaid one eligible gaming machine according to the bonus game rules;

awarding the selected bonus jackpot value to the aforesaid one eligible gaming machine based upon a win during play of the bonus game according to the bonus game rules;

subtracting each awarded bonus jackpot values from the bonus pool;

ending play of the bonus game when the bonus pool is brought to or below a predetermined value in response to the step of subtracting.

12. A method of operating a bonus game in a controller-based progressive jackpot linked gaming system having a controller and a plurality of gaming machines connected to the controller, said method comprising the steps of:

starting the bonus game in a display at each eligible gaming machine of the plurality of gaming machines when a bonus pool in the controller is activated, the bonus game having game rules different from the game rules for the gaming machines;

selecting in the controller a bonus jackpot value in response to each game play at any one of the eligible gaming machines;

displaying the selected bonus jackpot value in the display of the aforesaid one eligible gaming machine according to the bonus game rules;

wherein the step of selecting a bonus jackpot value includes selecting a null value and wherein the step of displaying the selected bonus jackpot includes the step of displaying a visual symbol in the display in response to selecting the null value;

awarding the selected bonus jackpot value to the aforesaid one eligible gaming machine based upon the bonus game rules;

subtracting the awarded bonus jackpot value from the bonus pool;

ending the bonus game when the bonus pool is brought to or below a predetermined value.

13. The method of claim 12 further comprising the step of audibly sounding a message in response to the step of selecting a null value.

14. The method of claim 11 further comprising the steps of:

displaying a win message in the display of the aforesaid one eligible gaming machine in response to the step of awarding the selected bonus jackpot value;

audibly sounding a win message in response to the aforesaid step of displaying.

15. The method of claim 14 further comprising the step of removing the win message and the displayed selected bonus jackpot values from the display of the aforesaid one eligible gaming machine after the step of awarding.

16. A method of operating a bonus game in a controller-based progressive jackpot linked gaming system having a controller and a plurality of gaming machines connected to the controller, said method comprising the steps of:

starting the bonus game in a display at each eligible gaming machine of the plurality of gaming machines when a bonus pool in the controller is activated, the bonus game having game rules different from the game rules for the gaming machines;

selecting in the controller a bonus jackpot value in response to each game play at any one of the eligible gaming machines;

displaying the selected bonus jackpot value in the display of the aforesaid one eligible gaming machine according to the bonus game rules;

awarding the selected bonus jackpot value to the aforesaid one eligible gaming machine based upon the bonus game rules;

wherein the step of awarding includes the steps of:

storing the selected bonus jackpot value when the prior stored bonus jackpot values for the aforesaid one gaming machine are different than the selected bonus jackpot value;

awarding the selected bonus jackpot value when the selected bonus jackpot value equals a prior stored jackpot value;

erasing the prior stored jackpot value equaling the selected bonus jackpot value in response to the step of awarding, subtracting the awarded bonus jackpot value from the bonus pool;

ending the bonus game when the bonus pool is brought to or below a predetermined value.

17. The method of claim 16 wherein the step of storing occurs in memory in the controller.

18. The method of claim 11 wherein the bonus jackpot is selected from a weighted payout table in the controller containing the plurality of bonus jackpot values.

19. A method for playing a bonus game in a gaming system having at least one gaming machine, said method comprising the steps of:

(a) displaying a matrix of images in a display at the at least one gaming machine;

(b) randomly selecting a bonus award when the at least one gaming machine is played;

(c) randomly selecting one of the images in the matrix of the display, (d) replacing the randomly selected image with a bonus award image corresponding to the randomly selected bonus award;

(e) repeating steps (b) through (d) until a matching combination of bonus award images occurs;

(f) awarding the bonus award corresponding to the matching combinations of bonus award images.

20. The method of claim 19 wherein the images are doors and the bonus award images are opened doors with the values of the bonus awards contained therein.

21. The method of claim 19 wherein the bonus awards include a null value and wherein the bonus award image corresponding to the null value is different from the other bonus award images.

22. The method of claim 21 wherein the bonus award image corresponding to the null value is an image of a person.

23. The method of claim 19 further comprising the step of audibly sounding a losing message to the area around the at least one gaming machine when said bonus award image corresponding to the null value replaces the randomly selected image in the matrix.

24. A method for playing a bonus game in a gaming system having at least one gaming machine, said method comprising the steps of:

(a) displaying a matrix of first images in a display at the at least one gaming machine;

(b) randomly selecting a bonus award from a set of values including a null value when the at least one gaming machine is played;

(c) randomly selecting one of the first images in the matrix of the display, (d) replacing the randomly selected first image with a second image containing the value of the randomly selected bonus award when the bonus award is other than a null value;

(e) replacing the randomly selected first image with a third image when the bonus award is a null value;

(f) audibly sounding a losing message in response to step (e);

(g) replacing the third image with a first image after a period of time in response to step (e);

(h) repeating steps (b) through (g) until a matching combination of values in the second images occurs;

(i) awarding the bonus award corresponding to the matching combination to the at least one gaming machine;

(j) audibly sounding a winning message in response to step (i).

25. The method of claim 24 wherein the first image is a closed door, the second image is an open door, and the third image is a person and wherein the losing message is the voice of the person.

26. The method of claim 24 wherein the matching combination is two values that are the same.

27. The method of claim 24 wherein the bonus awards constitute a bonus pool and further comprising the steps of:

(k) replacing the second images of the matching combination with first images in response to step (i);

(l) repeating steps (b) through (k) until the bonus pool is depleted of bonus awards.

28. A method of operating a bonus mode in a controller-based progressive jackpot linked gaming system having a controller and a plurality of gaming machines connected to the controller, said method comprising the steps of:

starting a bonus mode time period when a bonus pool in the controller is activated, the bonus pool having a value at activation;

determining eligible gaming machines in the plurality of gaming machines when the bonus mode time period starts;

starting play of a bonus game in a display at each of the eligible gaming machine of the plurality of gaming machines, the bonus game having game rules different from the game rules for the gaming machines;

providing a plurality of bonus jackpot values, each bonus jackpot value less in value than the value of the bonus pool;

selecting in the controller a bonus jackpot value from the plurality of bonus jackpot values in response to each bonus game played at any one of the eligible gaming machines;

displaying the selected bonus jackpot value in the display of the aforesaid one eligible gaming machine according to the bonus game rules;

awarding the selected bonus jackpot value to the aforesaid one eligible gaming machine when a win occurs at the bonus game according to the bonus game rules and allowing the bonus game to be replayed when a lose occurs at the bonus game according to the bonus game rules;

subtracting the awarded bonus jackpot values from the bonus pool;

ending play of the bonus mode time period when the value of the bonus pool is brought to or below a predetermined value in response to the step of subtracting.

29. A method of operating a bonus mode in a controller-based progressive jackpot linked gaming system having a controller and a plurality of gaming machines connected to the controller, said method comprising the steps of:

starting a bonus mode time period with a bonus pool having a value with eligible gaming machines in the plurality of gaming machines;

providing a plurality of bonus jackpot values;

starting a bonus game at each eligible gaming machine, the bonus game having game rules different from the game rules for the gaming machines;

randomly selecting in the controller a bonus jackpot value from the plurality of bonus jackpot values in response to each bonus game started;

awarding the randomly selected bonus jackpot value to the aforesaid one eligible gaming machine when a win occurs at the bonus game and playing the bonus game again with a new randomly selected bonus jackpot value when a lose occurs at the bonus game;

subtracting the awarded bonus jackpot values from the bonus pool;

ending play of the bonus mode time period when the value of the bonus pool is brought to or below a predetermined value in response to the step of subtracting.

* * * * *

UNITED STATES PATENT AND TRADEMARK OFFICE

CERTIFICATE OF CORRECTION

PATENT NO. : 6,146,273
DATED : November 14, 2000
INVENTOR(S) : Olsen, Eric B.

It is certified that error appears in the above-identified patent and that said Letters Patent is hereby corrected as shown below:

Column 31,
Line 49, replace "any" with --all--

Signed and Sealed this

Third Day of July, 2001

*Attest:*

Nicholas P. Godici

*Attesting Officer*

NICHOLAS P. GODICI
*Acting Director of the United States Patent and Trademark Office*